US005119981A

United States Patent [19]

Gnuechtel et al.

[11] Patent Number: 5,119,981

[45] Date of Patent: Jun. 9, 1992

[54] WEB GUIDE APPARATUS

[75] Inventors: Herman C. Gnuechtel, Arlington Heights; Stephen P. Kosmen, Hoffman Estates, both of Ill.

[73] Assignee: Web Printing Controls Co., Inc., Lake Barrington, Ill.

[21] Appl. No.: 573,862

[22] Filed: Aug. 27, 1990

Related U.S. Application Data

[63] Continuation of Ser. No. 265,423, Oct. 31, 1988, Pat. No. 4,991,761.

[51] Int. Cl.[5] ..... B65H 23/038

[52] U.S. Cl. ..... 226/15; 226/18

[58] Field of Search ..... 226/15, 18, 19, 20, 226/21, 22, 45, 46; 242/57.1; 250/560

[56] References Cited

U.S. PATENT DOCUMENTS

| | | | |
|---|---|---|---|
| 3,373,288 | 3/1968 | Otepka et al. | 226/20 X |
| 3,615,048 | 10/1971 | Martin | 226/20 |
| 3,724,732 | 4/1973 | Bonner | 226/20 |
| 4,015,843 | 4/1977 | Tennant | 226/19 X |
| 4,069,959 | 1/1978 | Bartell et al. | 226/21 |
| 4,204,619 | 5/1980 | Damour | 226/21 |
| 4,243,167 | 1/1981 | Sander | 226/21 |
| 4,291,825 | 9/1981 | Glanz | 226/18 |
| 4,361,260 | 11/1982 | Hanlan | 226/30 |
| 4,384,686 | 5/1983 | Wiley et al. | 242/57.1 |
| 4,528,630 | 7/1985 | Sargent | 364/469 |
| 4,719,575 | 1/1988 | Gnuechtel | 364/469 |
| 4,848,632 | 7/1989 | Mack et al. | 226/18 |
| 4,991,761 | 2/1991 | Gneuchtel et al. | 226/15 |

FOREIGN PATENT DOCUMENTS

| | | | |
|---|---|---|---|
| 3535011A1 | 1/1987 | Fed. Rep. of Germany . | |
| 0047747 | 3/1983 | Japan | 226/196 |

*Primary Examiner*—Daniel P. Stodola
*Assistant Examiner*—P. Bowen
*Attorney, Agent, or Firm*—Welsh & Katz, Ltd.

[57] ABSTRACT

A microprocessor-controlled web guidance system which automatically implements and maintains a proper lateral web alignment of a continuous web in a web printing press. A steering mechanism is provided which is controlled by a microprocessor system which utilizes infrared radiation for edge detection wherein multiple sensors are driven by means of stepper motors driving on a flexible linear cogged belt system. The system includes novel functions, and diagnostic and maintenance modes which may be programmed by the operator. A plurality of control panels are provided to enable the operator to select and program desired functions and to access desired modes. Self calibration and testing of the steering mechanism and the edge sensors is also provided.

7 Claims, 8 Drawing Sheets

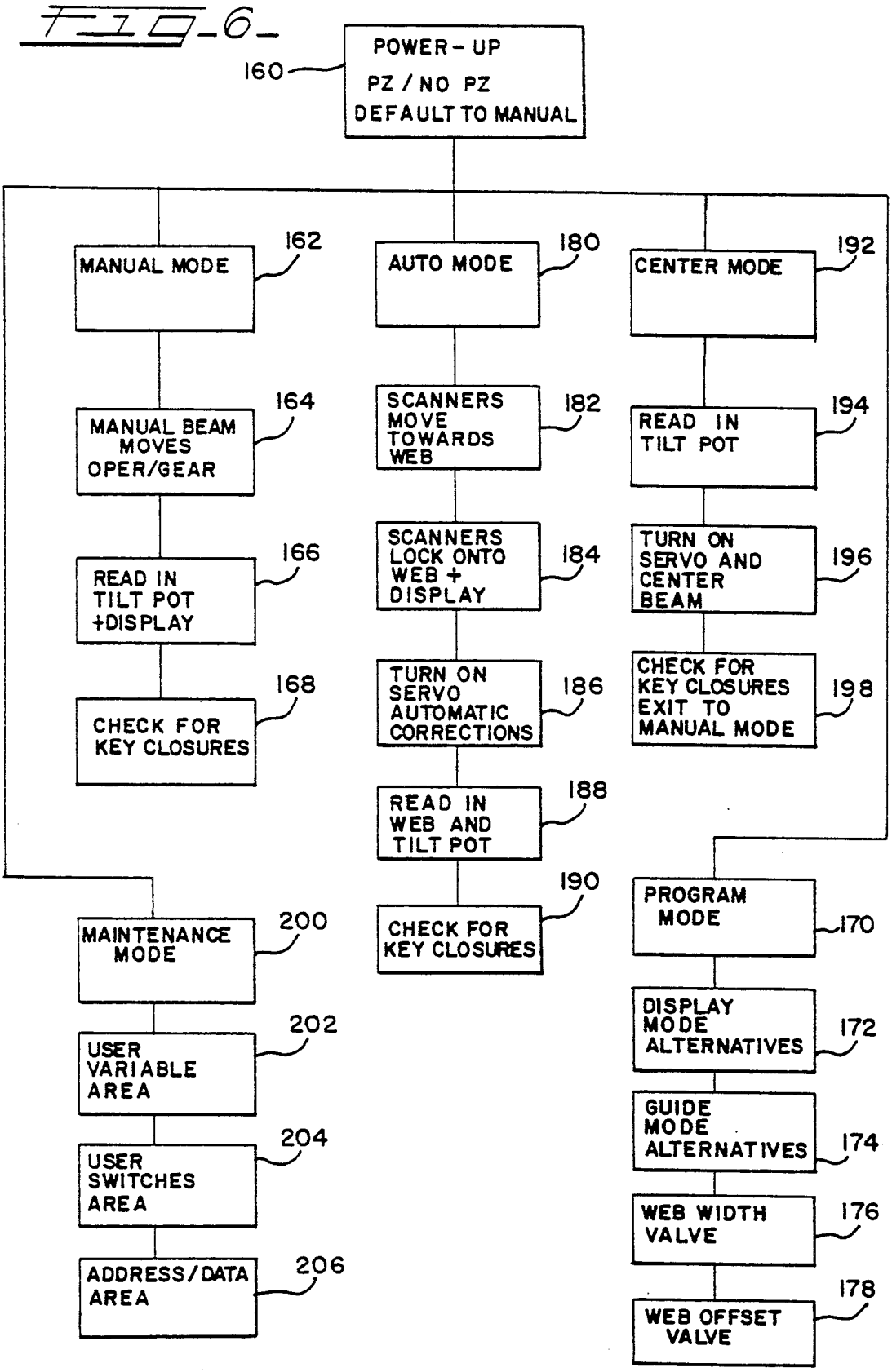
FIG-6
160
POWER-UP
PZ / NO PZ
DEFAULT TO MANUAL
MANUAL MODE
162
MANUAL BEAM MOVES OPER/GEAR
164
READ IN TILT POT +DISPLAY
166
CHECK FOR KEY CLOSURES
168
AUTO MODE
180
SCANNERS MOVE TOWARDS WEB
182
SCANNERS LOCK ONTO WEB + DISPLAY
184
TURN ON SERVO AUTOMATIC CORRECTIONS
186
READ IN WEB AND TILT POT
188
CHECK FOR KEY CLOSURES
190
CENTER MODE
192
READ IN TILT POT
194
TURN ON SERVO AND CENTER BEAM
196
CHECK FOR KEY CLOSURES EXIT TO MANUAL MODE
198
MAINTENANCE MODE
200
USER VARIABLE AREA
202
USER SWITCHES AREA
204
ADDRESS/DATA AREA
206
PROGRAM MODE
170
DISPLAY MODE ALTERNATIVES
172
GUIDE MODE ALTERNATIVES
174
WEB WIDTH VALVE
176
WEB OFFSET VALVE
178

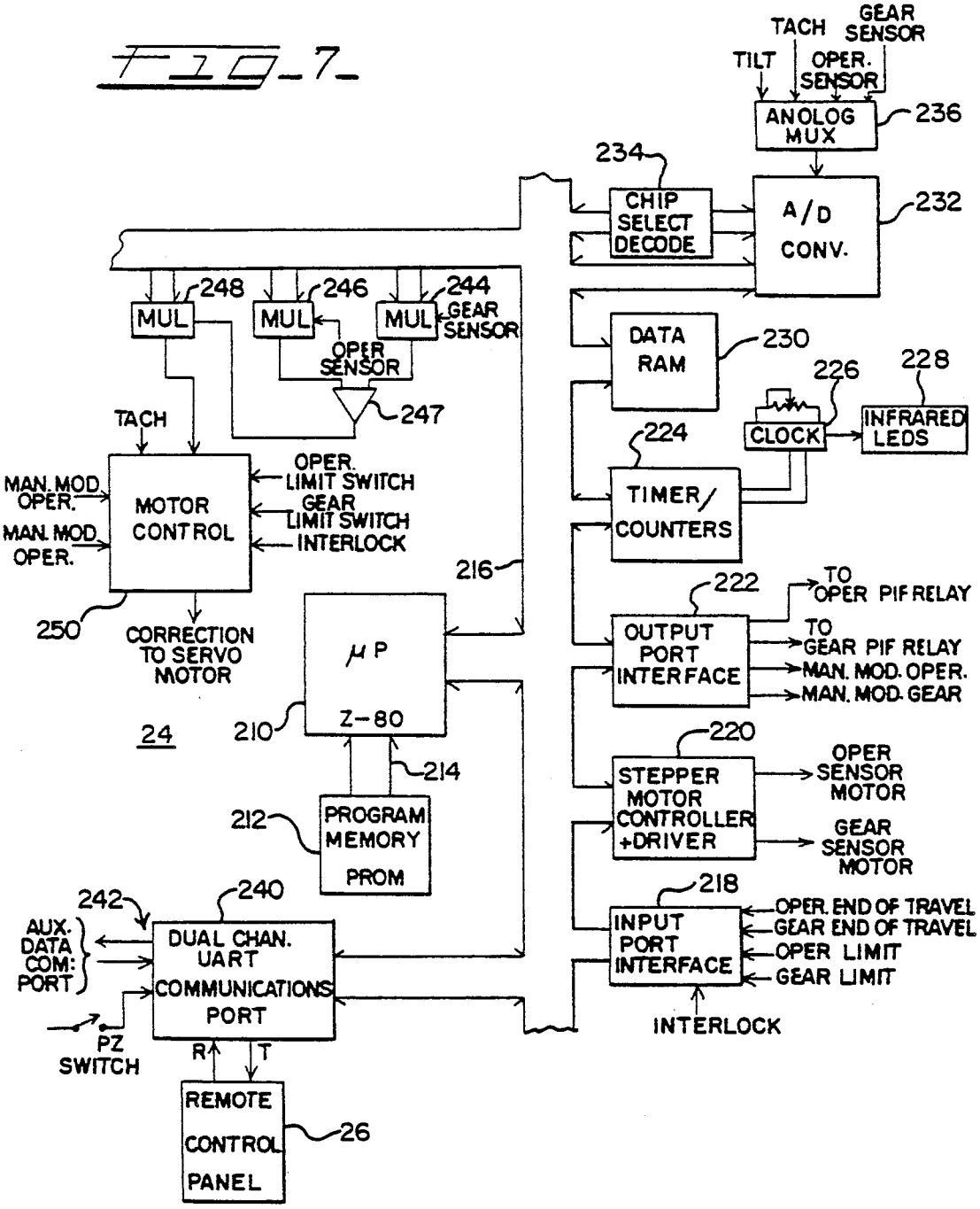
FIG-7
TACH
GEAR SENSOR
TILT
OPER. SENSOR
ANOLOG MUX
236
234
CHIP SELECT DECODE
A/D CONV.
232
248
246
244
MUL
MUL
MUL
GEAR SENSOR
OPER SENSOR
247
DATA RAM
230
226
228
CLOCK
INFRARED LEDS
224
TIMER/ COUNTERS
TACH
MAN. MOD. OPER.
MAN. MOD. OPER.
MOTOR CONTROL
OPER. LIMIT SWITCH
GEAR LIMIT SWITCH
INTERLOCK
216
250
CORRECTION TO SERVO MOTOR
μP Z-80
210
24
214
222
TO OPER PIF RELAY
OUTPUT PORT INTERFACE
TO GEAR PIF RELAY
MAN. MOD. OPER.
MAN. MOD. GEAR
220
STEPPER MOTOR CONTROLLER +DRIVER
OPER SENSOR MOTOR
GEAR SENSOR MOTOR
212
PROGRAM MEMORY PROM
242
240
218
AUX. DATA COM: PORT
DUAL CHAN. UART COMMUNICATIONS PORT
INPUT PORT INTERFACE
OPER. END OF TRAVEL
GEAR END OF TRAVEL
OPER LIMIT
GEAR LIMIT
INTERLOCK
PZ SWITCH
R
T
REMOTE CONTROL PANEL
26

WEB GUIDE APPARATUS

This is a continuation, of application Ser. No. 265,423, filed Oct. 31, 1988 now U.S. Pat. No. 4,991,761, issued Feb. 12, 1991.

BACKGROUND OF THE INVENTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

This invention relates generally to web handling apparatus and more particularly to a microprocessor controlled web guidance system to automatically implement and maintain proper lateral web alignment of a continuous web in a web handling system such as a printing press. In numerous industrial commercial processes, operations are performed in a continuous travelling web of a thin material, such as paper or plastic film, etc., which move through machines at high speed. Such web process operations include, for example, printing of newspapers or magazines, coating the moving web, slitting the moving web lengthwise, cutting the moving web transversely, etc. These operations usually require accurate lateral alignment of the web to maintain the web in proper registry with the machine that operates on the web. However, the moving web often shifts laterally from a proper lateral position on the rollers supporting it resulting in lateral misalignment relative to the machine. This displacement of the web from its proper lateral position interferes with the operations being performed on the web and often results in wastage and/or a crash of the web handling system. Thus, it is usually necessary to correct any misalignment as promptly as possible. Consequently, web guide devices which sense the lateral position of the web and automatically adjust the lateral position of the web when it deviates from a desired position are commonly used in the art.

It is known in the art to use web guide apparatus which includes a stationary support frame with a moveable steering frame mounted on the support frame. This moveable frame is steered by an appropriate positioning device such as a hydraulic cylinder or an electric motor, and normally includes a pair of spaced, parallel steering rollers over which the web is run. A sensor detects the lateral position of the web as it leaves the steering rollers and generates a signal to control the steering frame positioning motor. The moveable steering frame is pivoted relative to the support frame by the positioning motor about a pivot point along the center line axis of the incoming web. This pivoting action moves the rollers such that the web is repositioned laterally as it moves along and over the guide rollers.

In some prior art web guide apparatus, the sensing of the alignment of the moving head is accomplished by using a single web edge detector, such as a photodetector or infrared detector, positioned at one lateral edge of the moving web to detect transverse displacement of the web edge. In other situations, the width of the moving web may vary so that two edge detectors have been used to monitor both edges of the web. In addition, moveable edge detectors have been used in the prior art. Systems have also been proposed which provide a digital readout display of the correction being made to the position of the web.

Prior art web guide systems have numerous deficiencies. Such systems do not provide diagnostic and maintenance modes of operation to aide in the operation of the apparatus. Inability to calibrate the tilt mechanism makes it difficult to set trip points to stop or adjust the web handling line. These limitations often lead to undesirable and expensive crashes of the web handling line. In addition, control and drive mechanisms for the movement of the edge sensors has been inadequate leading to failure to keep track of sensor position and inaccurate position of the sensor due to gear backlash. The present invention overcomes these and other deficiencies of the prior art web guide apparatus and provides new and additional features not heretofore available.

Accordingly, it is an object of the present invention to provide a novel microprocessor controlled web guidance system having novel maintenance and diagnostic features.

It is another object of the invention to provide a novel microprocessor controlled web guidance system having a novel tilt mechanism calibration system for calibrating the full scale gain of the tilt mechanism.

It is yet another object of the invention to provide a novel microprocessor controlled web guidance system having a novel edge sensor drive mechanism utilizing a cogged linear belt in conjunction with stepper motors and counting means to keep track of the edge sensor position.

It is still another object of the invention to provide a novel microprocessor controlled web guidance system having a plurality of control panels with serial communications between the control panels and the control circuitry.

Briefly, according to one embodiment of the invention, a web guidance system is provided for automatically controlling alignment of a moving web. The system comprises a stationary support frame and a pivotable frame attached to the support frame and pivotable over a predetermined range, including parallel steering rollers for receiving the moving web. Sensing means is provided including at least one edge sensor positionable along either longitudinal edge of the web for sensing a transverse deviation in the position in the longitudinal edge of the web and for generating an error signal in response thereto. Control means is provided for generating a control signal responsive to the error signal for automatically correcting the deviation of the web position, and drive means is provided for controlling the angular position of said pivotable frame by pivoting the pivotable frame responsive to the control signals. In addition, manual means are provided to enable an operator to assume manual control of the drive means, and maintenance means provides maintenance modes of operation and can enable an operator to select functions and diagnostic, self-calibrating or maintenance modes of operation.

BRIEF DESCRIPTION OF THE DRAWINGS

The features of the present invention which are believed to be novel are set forth below with particularity in the appended claims. The invention, together with further objects and advantages thereof, may be understood by reference to the following description taken in conjunction with the accompanying drawings.

FIG. 6 is a flow diagram illustrating the processing flow and logical methodology of the program for the control circuitry of the web guide system shown in FIG. I.

FIG. 7 is detailed block diagram illustrating a specific embodiment of the circuitry for the control circuitry shown in FIG. 1.

DETAILED DESCRIPTION OF THE PREFERRED EMBODIMENT

Figure 1:
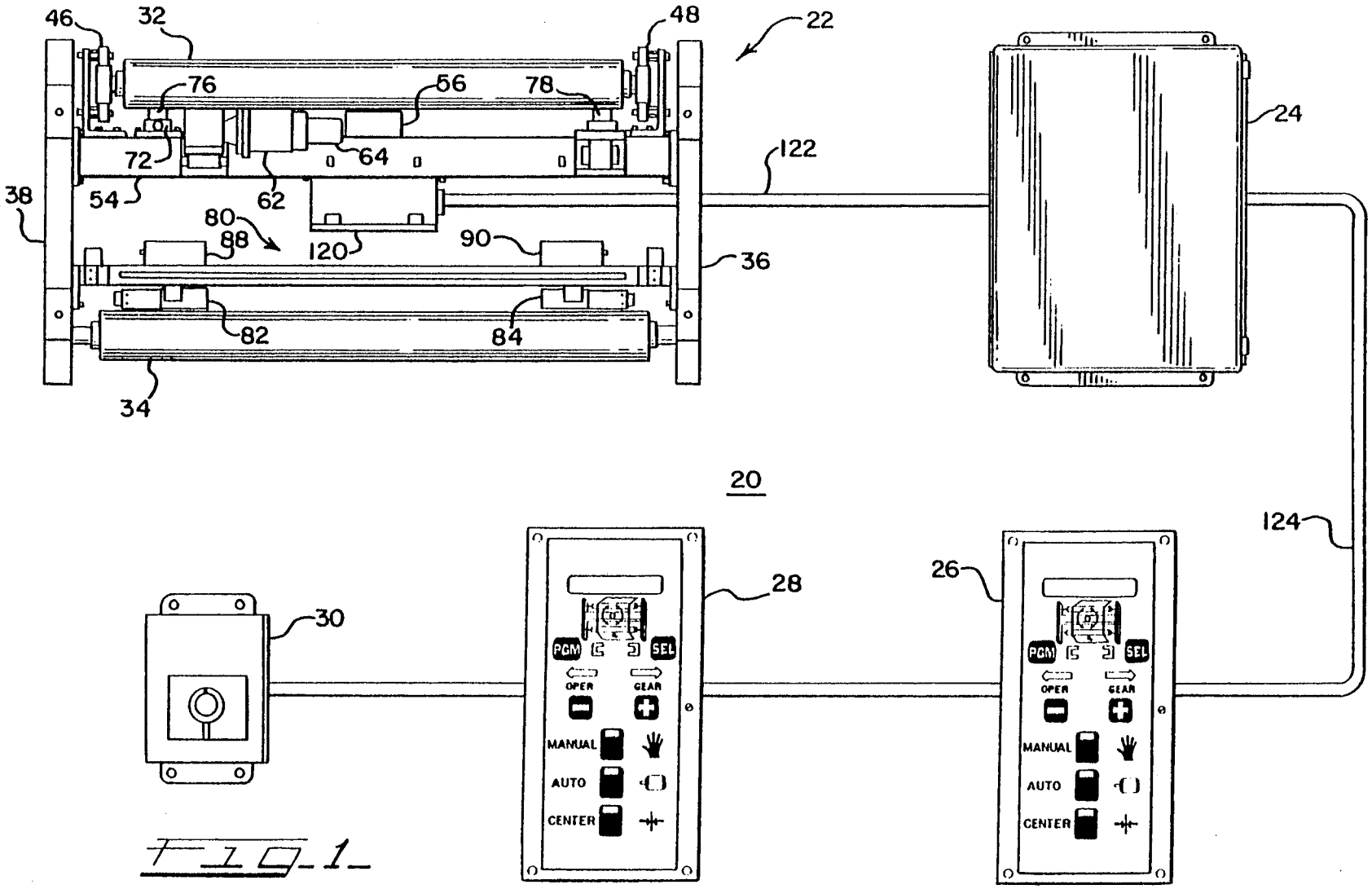
FIG. 1 is a diagrammatic illustration of a specific embodiment of a web guide system in accordance with the invention.

Referring to FIG. 1 there is shown a diagrammatic illustration of a web guide system 20 in accordance with the present invention for use with a web printing press. The system 20 includes a web guide assembly 22, control circuitry 24, a control panel 26, an optional remote control panel 28, and an optional auxiliary control panel 30. The web guide assembly 22 is shown with a front view having a exit steering roller 32, which forms the exit roller of the steering or tilt mechanism, shown in more detail in FIG. 3A, and having a lower exit roller 34, functioning as an exit roller. The rollers 32 and 34 are mounted on a stationary frame composed of a gear edge plate 36 and an operator edge plate 38. Near the exit roller 34 a scanner mechanism 80 having two edge sensors 82, 84 is mounted to the gear edge plate 36 and operator edge plate 38, as shown. The terms "gear" and "operator" are commonly used in the art, and are used herein to designate a particular side of the press, the "operator" side being where the operator normally works, and the "gear" side being where the press drive gear mechanism is normally located.

Figure 2:
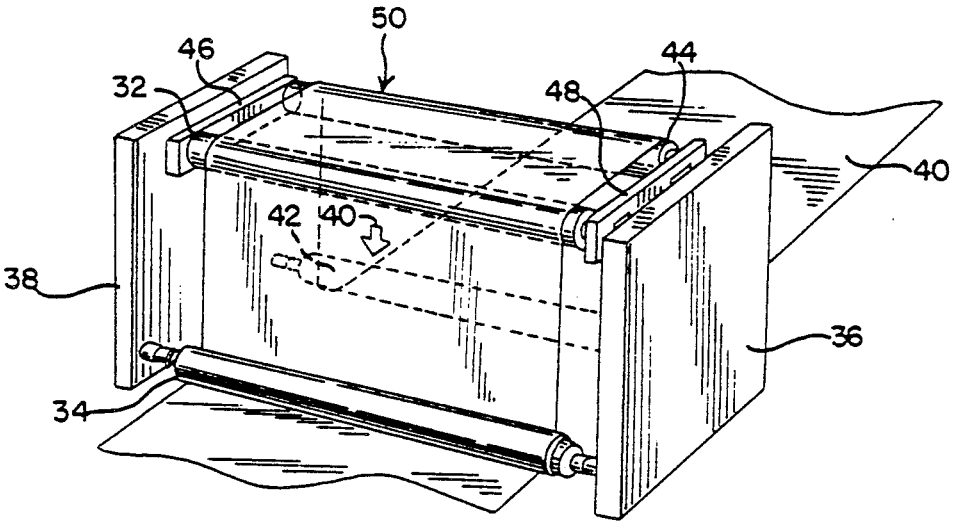
FIG. 2 is a perspective view of portions of a specific embodiment of the web guide assembly shown in FIG. 1 with parts removed to illustrate a web threaded therethrough.

FIG. 2 is a perspective view of the web guide assembly 22 with portions removed to illustrate a specific example of the travel of the web 40 through the assembly 22. The web 40 is threaded from an idler entrance roller 42 over a lead-in steering roller 44 and the exit steering roller 32 and under the exit roller 44, as shown. The steering rollers 32 and 44 form a steering mechanism 50, and are rotatably mounted on the steering roller support members 46, 48.

Figure 3A:
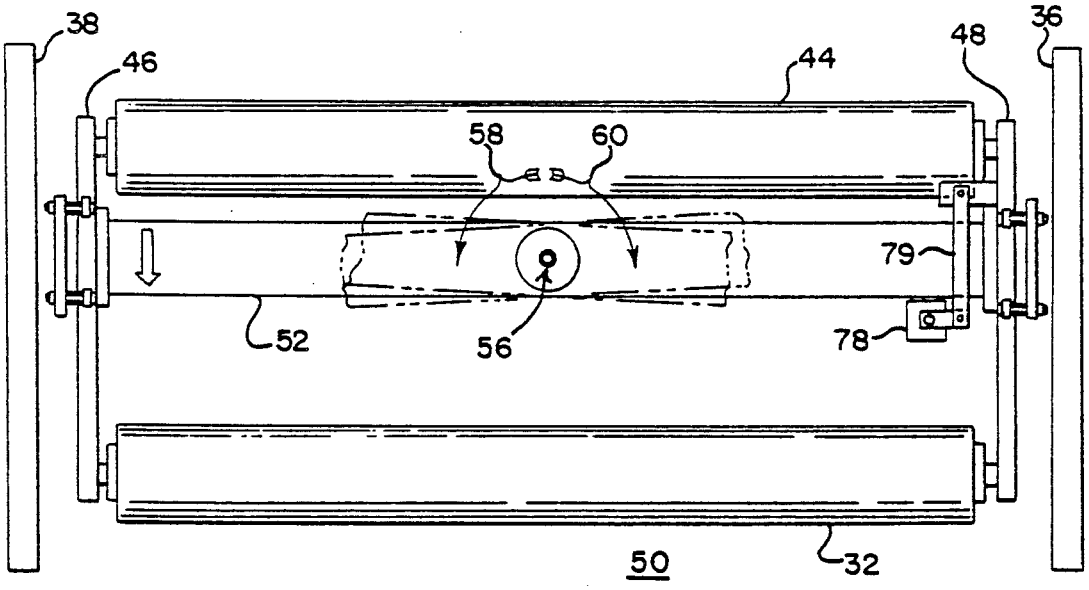
FIG. 3A is a top view illustrating a specific embodiment of the steering roller assembly of the web guide assembly shown in FIG. 1.
Figure 3B:
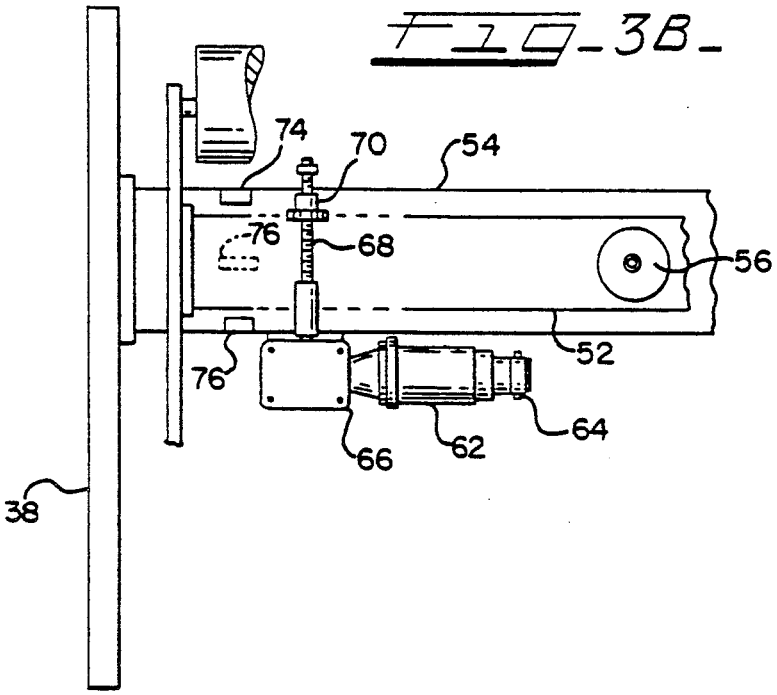
FIG. 3B is a top view of a portion of the steering assembly shown in FIG. 3A.
Figure 3C:
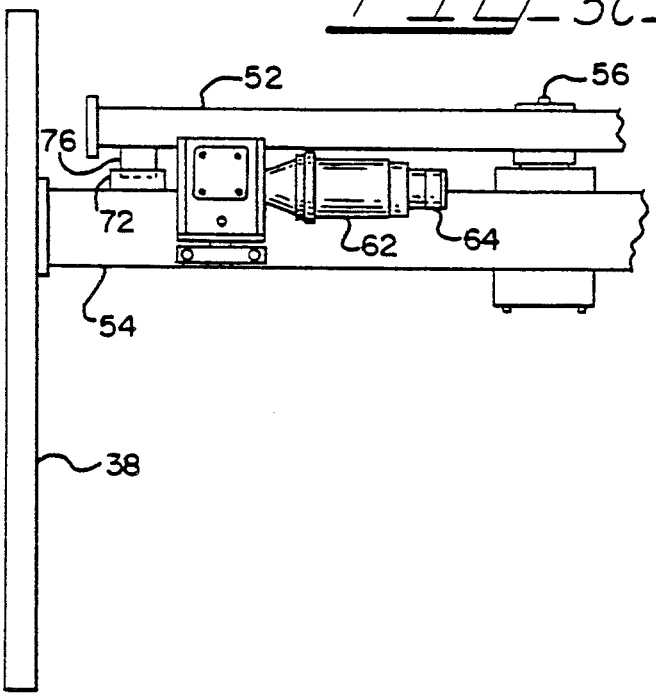
FIG. 3C is side view of a portion of the steering assembly shown in FIG. 3A.

The steering mechanism 50 is illustrated in greater detail in FIGS. 3A, 3B, and 3C. FIG. 3A is a top view of the steering assembly 50, with the drive mechanism removed, having the side members 46, 48 mounted on a steering pivot beam 52. The pivot beam 52 is mounted on a support cross-member 54 (See FIG. 1 and FIG. 3B) by means of a pivot mechanism 56. The support cross-member 54 is mounted on the stationary frame side plates 36, 38 as shown in FIG. 1. The pivot mechanism allows the steering assembly 50 composed of the lead-in and exit steering rollers 44, 32, the side members 46, 48, and the pivot beam 52 to be angularly pivoted (tilted) about the axis of the pivot mechanism 56 in the directions shown by the arrows 58, 60 relative to the support cross-member 54. An offset center pivot is utilized with the pivot 56 offset toward the lead-in side of the steering mechanism 50 to provide the greatest web movement as a function of pivot position with respect to minimum web distortion. The offset also pushes the web in the direction of the correction thereby yielding a faster correction rate. A tilt potentiometer 78 is also coupled to the steering mechanism 50 by a coupling mechanism 79 and mounted on the support cross member 54. The tilt potentiometer 78 provides a position signal which permits the control circuitry 24 to monitor the relative position of the steering pivot beam 52.

The pivot beam 52 is driven angularly in either direction by a drive means including a DC motor 662, as shown in the top view of a portion of the steering mechanism 50 illustrated in FIG. 3B. The motor 62, includes a tachometer 64, and is coupled to a gear box 66 mounted on the support cross-member 54. A lead screw gear assembly 68 extending from the gear box 66 and driven by the motor 62 drives the pivot beam 52 to the desired angular position by interaction with a ball bearing nut assembly 70 mounted on the pivot beam 52, as shown. The tachometer 52 permits the system control circuitry 24 to monitor the speed at which the beam is pivoted and uses this signal as a feedback signal to aid in controlling the correction motor 62. Limit switches 72, 74 mounted on the support cross-member 54 interact with a paddle 76 to provide a limit signal to the control circuitry 24 when the pivot beam 52 reaches maximum permitted angular displacement. The structure of the steering assembly 50 may be more fully appreciated by inspection of the side view of a portion of the steering mechanism illustrated in FIG. 3C.

Figure 4B:
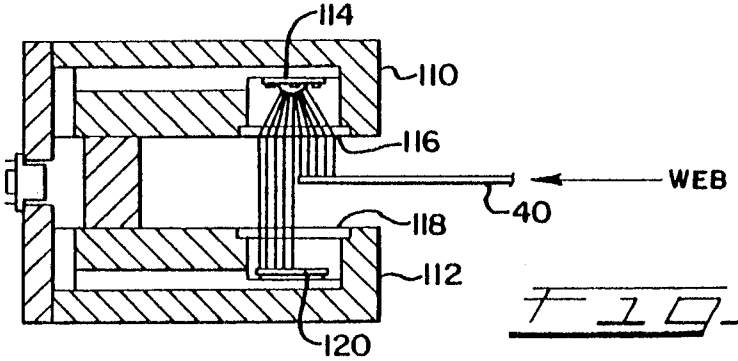
FIG. 4B is a diagrammatic cross-sectional top view of the scanner edge sensor shown in FIG. 4A.
Figure 4A:
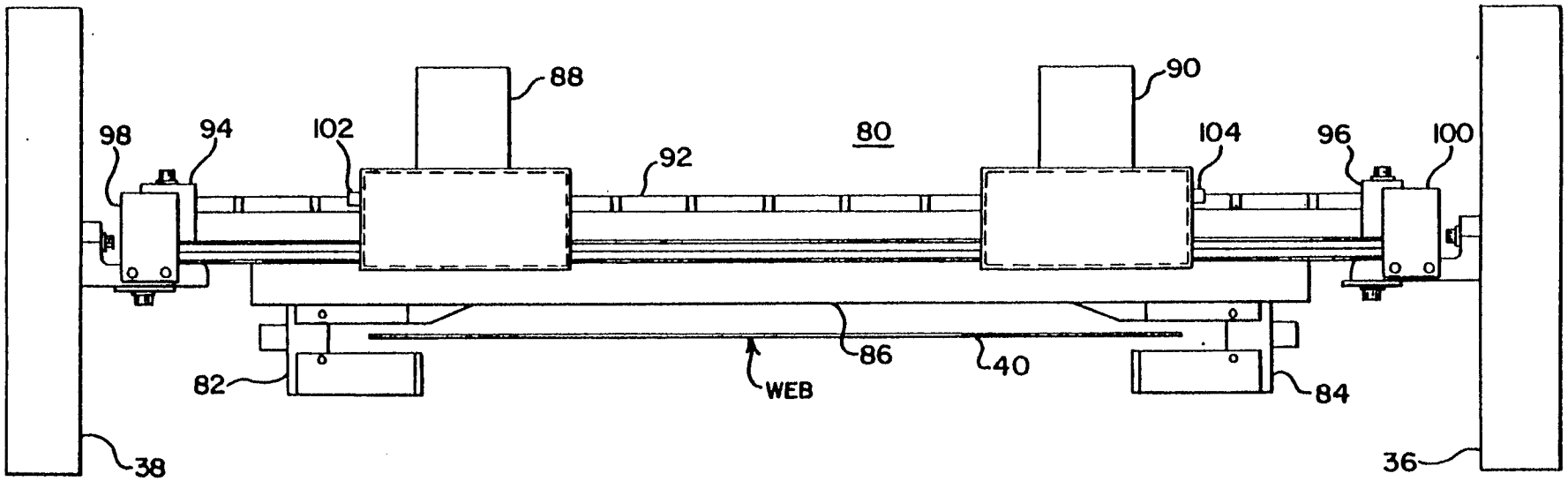
FIG. 4A is a top view illustrating a specific embodiment of the scanner mechanism according to the invention.

Referring now to FIG. 4A there is illustrated a top view of a specific embodiment of the scanner mechanism 80 shown in FIG. 1. The scanner mechanism 80 is mounted on the operator edge support plate 38 and gear edge support plate 36 of the stationary support frame, as shown. The scanner mechanism includes two movable edge sensors, an operator edge sensor 82 and a gear edge sensor 84 movably mounted on a scanner bar 86. The edge sensors 82, 84 are also coupled to drive means comprising an operator sensor synchronous stepper motor 88 and a gear sensor synchronous stepper motor 90 which are movably mounted to engage a linear cogged belt 92. This structure enables backlash free movement of the sensors 82, 84 by the independent stepper motors 88, 90 while ensuring accurate location of the sensors. The stepper motors 88, 90 are controlled by signals coupled from the control logic 24. An operator side tensioner 94 is provided, as shown, to ensure proper tension of the belt 92. An operator end of travel block 98 and gear end of travel block 100 interact with end of travel sensors 102 and 104, respectively, to provide end of travel signals to the control circuitry 24.

The operation of the edge sensors 82, 84 is illustrated in the diagrammatic cross sectional top view of an edge sensor in FIG. 4B. Each sensor is constructed having two separated arm portions 110 and 112, as shown. In one arm 110 is located a source of radiation 114 emitting infrared light in the illustrated embodiment. The infrared light emitted by the source 114 is modulated by a 2 KHz modulating signal in the illustrated embodiment to mask out ambient light. In addition, a transparent cover 116 is mounted, as shown, and the infrared light radiates through the cover 116 into a channel having a width which encompasses the typical range of web edge deviation from a desired or predetermined position. In the other arm 112 of the sensor is another transparent cover 118 which passes the portion of the infrared light that passes the edge of the web 140 extending between the arms 112, 114. A detector 120, such as an infrared photocell, receives the infrared radiation and produces an input signal corresponding to the magnitude of the infrared radiation impinging upon the detector 120. As shown, the sensor is positioned such that the web blocks part of the light path. Thus, the amount of infrared radiation block is directly proportional to the web position and the signal generated by the detector 120 is directly related to the web position.

Two sensors are supplied with the system to permit several types of operation. When guiding in the center mode using two sensors the system essentially compares the output of both sensors and adjusts the steering mechanism to position the web such that the signal from both sensors is equal. When edge guiding the system compares the output of the selected sensor with a preset constant. This preset constant is set such that the steering mechanism positions the web in the middle of the sensor. In the center mode using both sensors, the centerline of the web is what the system accurately holds in position. In the edge mode, the edge selected is the side the system holds accurately.

The web guide assembly 22, including the steering mechanism motor 62 and the sensor motors 88, 90 is controlled by control signals coupled via a junction block 120 and a cable 122 to the web guide assembly 22 from the control circuitry 24, as shown in FIG. 1, to provide control of the course of the web 40, either automatically or manually. The control circuitry 24 is described in greater detail hereinafter with reference to FIGS. 7 and 9. Operator control of the circuitry is provided by a control panel 26, and optional additional control panels including a number of additional remote panels 28 and auxiliary control 30, as shown. The control panels 26 and 28, are identical and permit operator control of the web guidance system 20 while the auxiliary control permits manual adjustment of the steering mechanism 50. The control panels 26, 28, 30 are connected in parallel and utilize a serial, full duplex communications protocol to communicate via a cable 124 with the control circuitry 24. The control panel circuitry is described in detail hereinafter with reference to FIG. 8.

Figure 5:
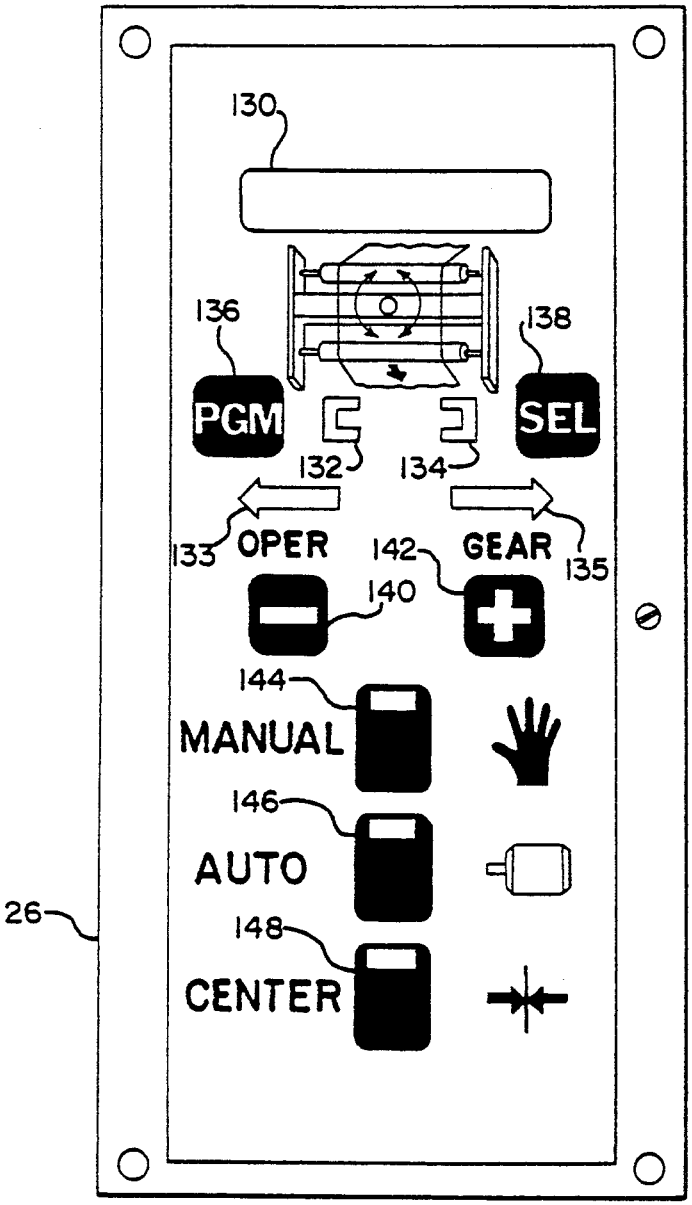
FIG. 5 is a front view illustration of a specific embodiment of the control panel shown in FIG. 1.
Figure 8:
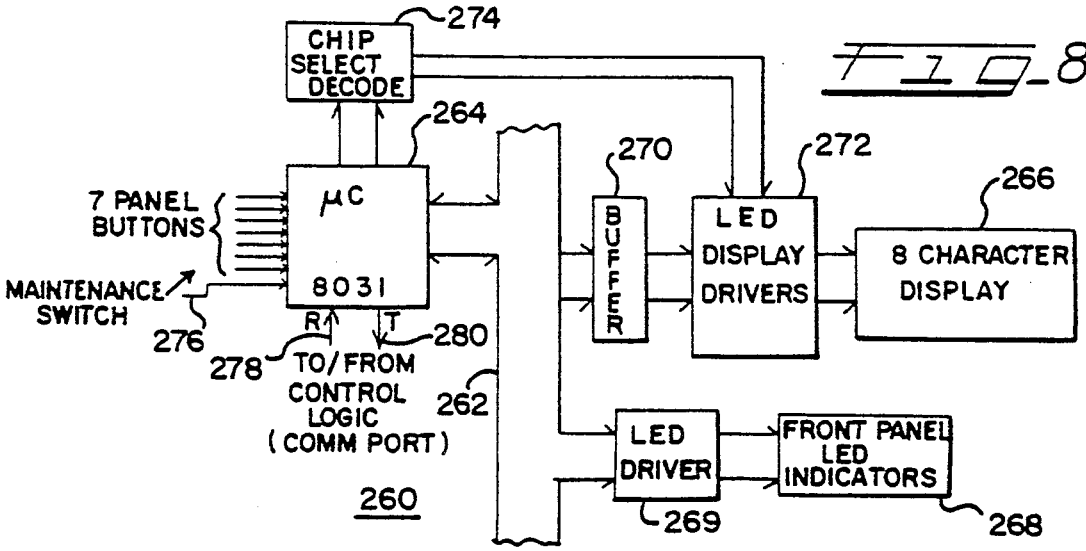
FIG. 8 is a detailed block diagram illustrating a specific embodiment of the circuitry for the control panel shown in FIG. 5.
Figure 9:
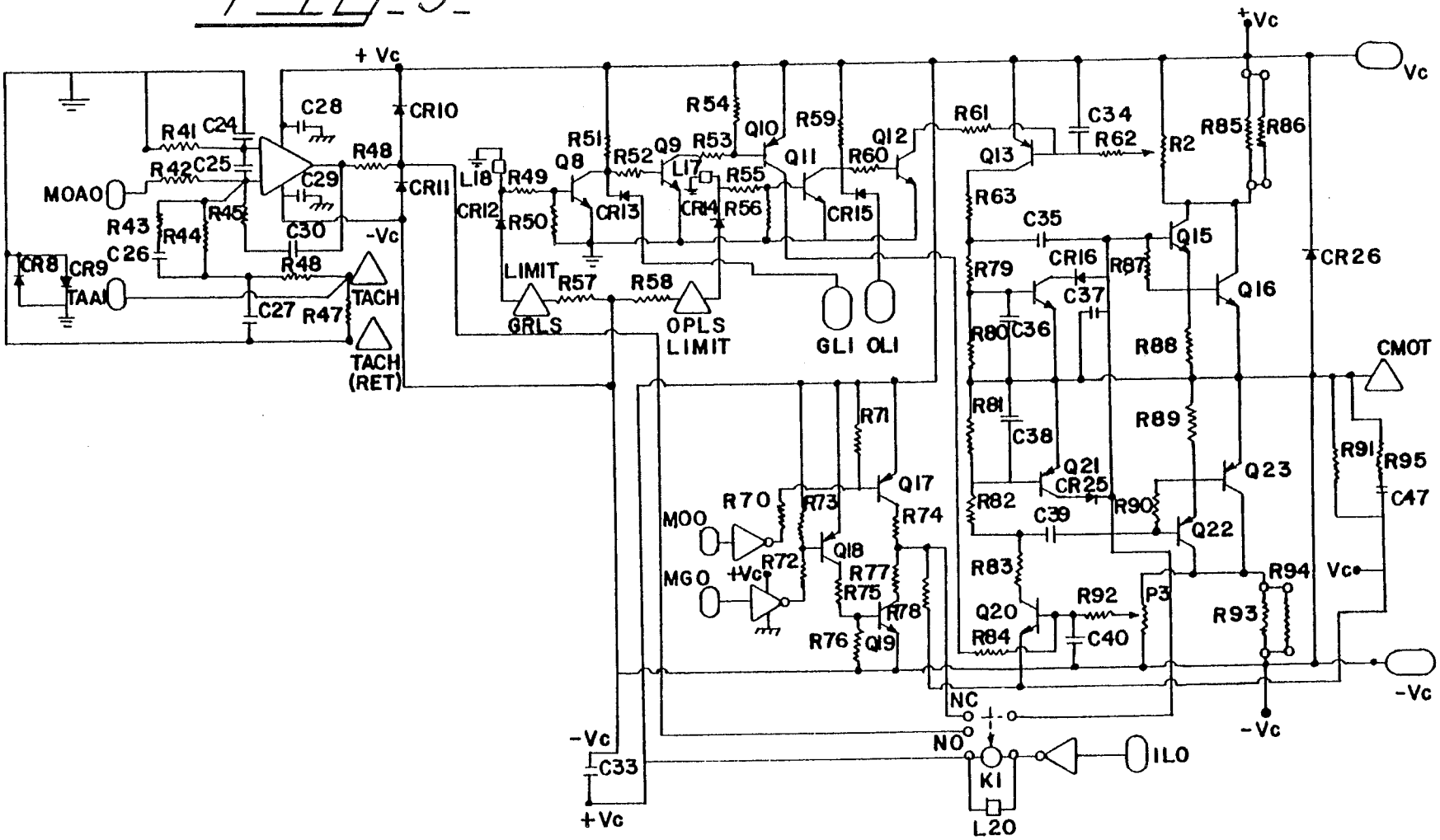
FIG. 9 is a schematic diagram of the correction motor control circuit shown in FIG. 7.

Referring now to FIG. 5, there is shown a detailed front view of the control panel 26 which operates in conjunction with the control panel circuitry shown in FIG. 8, the control circuitry shown in FIG. 7, and the edge sensors, end of travel sensor, limit switches, motors, and other devices that control the web guide assembly to perform the functional operation selected by the control panel 26. The control panel 26 includes an eight character alphanumeric readout display 130 capable of displaying or scrolling alphabetic or numeric characters. The control panel also includes guide mode indicators 132, 134, motor direction indicators 133, 135 and various panel keys. The panel keys include a program mode (PGM) key 136, a select (SEL) key 138, and operator correction (−) key 140, a gear correction (+) key 142, a manual mode key 144, an auto mode key 146, and a center mode key 148, as shown. Each of the Manual, Auto and Center keys has an associated indicator lamp (e.g., an LED in the illustrated embodiment), as shown, to indicate when the key is activated.

Although, typically the web guidance system 20 is operated to control the course of the web either automatically or manually, five primary functional modes of operation are available to the operator through the control panel. FIG. 6 is flow diagram illustrating the functional flow and methodology of a program for the microprocessor of the system control circuitry 24 in accordance with the invention, and illustrates the five primary functional modes. The five primary functional modes of the system operation are MANUAL, AUTO, CENTER, PROGRAM and MAINTENANCE modes. A program listing for the process illustrated in FIG. 6 for the control circuitry processor (Z-80) of the illustrated embodiment is provided in Appendix A attached hereto.

Referring to FIG. 6, the system upon power up initializes to default values stored in memory if the PZ switch is held on, and otherwise retains values set during previous operation, as illustrated at block 160. Also, as illustrated at block 160, upon power-up the system automatically enters the manual mode by branching to block 162, as shown. While in any mode, the system continually checks for panel key depressions to enable the system to respond to the control panel key selections made by the operator. In the manual mode, the steering mechanism 50 pivot beam 52 may be moved using the operator correction key 140 and the gear correction key 142, as illustrated at block 164. Thus, the web can be shifted in the operator direction by use of the operator key 140 and in the gear direction by depressing the gear key 142. The readout during this mode will monitor and display the current steering beam tilt in a gear or operator percentage or will display "00 CNTR" for the condition in which the steering beam is perfectly centered, as illustrated by block 166. The message "LIMIT" will flash in the readout display 130 whenever an operator or gear tilt limit occurs and the corresponding correction indicator will also flash. This condition will remain until the steering beam is moved off of the limit. The manual mode may be selected while in any of the other modes, and the edge sensors will retract during the manual mode if they are not already fully retracted. As illustrated at block 168, the system checks for key closures to detect operator selection of another mode or tilt instruction.

The program mode (PGM) may be entered while in the manual mode or in the auto mode by branching program control to block 170. The program mode is used to select display and guide mode options and also to specify and program the web width and lap offset values that the operator desires to be used. Upon entering the program mode at block 170, a "display mode" display will be scrolled across the readout 130 and either "TILT %" or "WEB POS" will appear displayed on the readout to indicate which display option was previously selected. The display mode desired is selected by depression of the selection (SEL) key 138. All depressions of the selection key will alternate the display between the two display mode options, thus displaying the available modes as indicated at block 172. This permits the operator to chose between what information will be displayed in the auto mode operation. The manual mode displays tilt percent only. Tilt percent represents the rotational position of the steering mechanism in percent of maximum rotation while the web position option displays the position of the web within the scanners. The display mode is the only mode that can be entered and changed while running in the auto mode. If the display mode is entered from the auto mode, the auto mode can then be reentered by depressing the auto key.

If the program mode was entered from the manual mode, then a second depression of the PGM key 136 will implement the guide mode option. Once this mode is entered, as indicated at block 174, the display "GUIDE MODE" will scroll across the readout 130, and either "OP EDGE", "GR EDGE", or "CENTER" will be displayed to indicate which guide mode operation was previously selected. Depression of the SEL key 138 will rotate through these three guide mode options to permit selection of the desired option by the operator. These options tell the system which scanner will be used when running in the auto mode. The "OP EDGE" mode indicates that only the operator sensor 82 is the active sensor, the mode "GR EDGE" is the mode in which only the gear sensor 84 is active, and the mode "CENTER" is the mode in which both scanners are active. The sensor LED indicators 132 and 134 are lighted to indicate which guide mode option the system is using. In the various modes, the sensor that is turned off will remain retracted and will also not be checked for scanner fault conditions.

By depressing the PGM key 136 a third time, processing proceeds to access the web width selection mode as indicated at block 176. In this mode, the display "WEB WIDTH" will scroll across the readout 130 and a value in inches will be displayed indicating the web width previously selected. The operator key 140 and gear key 142 may then be used to decrease or increase, respectively, the displayed value in ⅛ inch increments. The gear key 142 will increase and the operator key 140 will decrease the web width value while a constant depression will speed up the value selection process. The exact width in inches of the web being used must be entered for proper operation of certain auto mode functions such as the "find and put" process of presetting scanner positions on initial starting conditions. However, if the auto mode function of "seek and hold" is used, then the web width does not need to be specified.

Upon a fourth depression of the PGM key 136, program flow proceeds to block 178 to the web offset value selection function where the message "WEB CENTERLINE TO PRESS CENTERLINE OFFSET" will scroll across the readout 130 and the value in a fraction of an inch increments (e.g., ⅛", 1/16", etc.) in either a gear or operator direction or a zero center indication will be displayed. This value represents the position of the desired web offset with respect to the centerline of the press. The web offset value must be correctly entered in order for the find and put operation to function, but is not necessary if the seek and hold mode of operation is used. The gear (+) key 142 will increase the offset value to the gear direction and the operator (−) key 140 will decrease the offset to the operator direction. Subsequent depression of the PGM key 136 will return control to the block 170 to permit rotating through the options and values again. At this point, the auto mode or the manual mode may be selected by depressing the auto key 146 or manual key 144. Throughout this mode, the processor continuously monitors the control panel for key depressions.

Upon completion of the sequence of selections in the program mode, program control may be branched to the auto mode illustrated at block 180 by depressing the auto mode key 146. The auto mode may be implemented using any one of two methods. A seek and hold method may be used when the press is already running above interlock speed when the auto key 146 is depressed. In this mode, the active edge sensor or sensors travel to the edge of the web while the message "SCANNERS SEEKING" is scrolled across the readout 130, as illustrated at block 182. When the edge sensors are locked on to the web, a message "LOCKED" will be displayed and flashed on the readout, as indicated at block 184. The system will then turn on the automatic correction and begin to compensate for any lateral error in the web, as indicated at block 186. The gear 135 and operator 133 indicator lamps (LEDs) will blink in response to the steering beam movements and the readout will display either tilt percent or web position depending upon which display was selected in the display mode during the program mode. These functions are performed to determine the web position by reading the edge sensors and determining the steering beam 52 movements by reading in the value from the tilt potentiometer 78, as indicated at block 188. As indicated at block 190, the processor continually monitors key closures on the control panel in order to respond to operator selections.

A second method of implementing the auto mode is the find and put method of auto mode operation which can occur when the auto mode is selected at a time when the press is below the interlock speed or not running. In this mode, the activated edge sensor or sensors will travel to within two inches of the edge of the web and stop while the readout 130 scrolls the message "WEB WIDTH" followed by a number and "OFFSET" followed by a number, and then scrolls "scanners presetting", as indicated at block 182. The readout 130 then flashes "ready" and the system waits for an indication that the press speed is above interlock from the interlock feedback signal at which time the scanner or scanners will move in to find the edge of the web. Once the web edge is found, a "locked" message will flash on the readout 130 as indicated at block 184 and the system then puts the web in the preset position designated by web width and offset values and maintains the automatic correction as indicated at block 186. Once the web is in the proper position on the web guide, the readout 130 displays the tilt percent or web position as selected in the display mode. The correction lights 133 and 135 are lit to provide an indication of steering beam movements. The web position and tilt percent values are obtained by reading in the sensor outputs and tilt potentiometer value as indicated at block 188.

Once one of the two methods of entering the auto mode is implemented the system can be left in the auto mode until the operator desires to stop the run or until parameters are changed. Upon emergency stops, such as web breaks and other times during which the press speed drops below the interlock speed, the web guide system 20 will scroll "below interlock" on the readout 130 and the sensors 82 and 84 will partially retract to two inches from the edge of the expected web position. Once this has occurred a message "ready" will then flash on the readout to indicate that the auto mode is still implemented and that compensation of the lateral motion can be resumed as soon as the press is brought back to operation. When in this condition due to an interlock dropout, the system 20, in one mode, will maintain in memory the position of the web and steering beam a predetermined time (e.g., 20 seconds) prior to the interlock dropout. When the press accelerates back up through the interlock speed, the sensors will begin to seek the edge of the web and the message "scanner seeking" will be scrolled across the readout 130. The previous web positions will be reestablished by the web guide after the sensor or sensors have relocated the web edge and have locked on and then the readout 130 will flash "locked". The system then continues to run in the auto mode, correcting for any lateral error and displaying either the tilt percent or web position values as selected. An alternative mode may be selected in which the steering mechanism is returned to a center position after the interlock drop out so that when the system is restarted it begins with the web guide aligned to a centered position.

Upon each entry of the auto mode, a self test of the edge sensors 86, 84 is performed to verify that the edge sensors are working correctly. The test is performed by automatically turning the infrared source 114 on and obtaining a full scale reading, then turning the source 114 off and testing for zero output of the detector 120. This test prevents a situation in which the sensor has its output jammed and the system then looks for a decrease which can't occur. In addition, a check for full scale calibration is made and if full scale output is below a threshold, a message "scanner fault clean scanners" is scrolled across the readout 130, and the system goes into manual mode. The operator would then have to clean the scanner before the auto mode could be activated. If there are three such failures to enter auto mode in sequence, a message "scanner fault, call maintenance" is generated. Finally, if full scale voltage from the scanner is not correct, but is more than the threshold, then an autocalibration is performed. The gain of the detector amplifier is modified to bring the output signal to full scale. In this way, compensation for a small amount of dirt on the edge sensor can be provided.

The center mode may be entered by depressing the center key 148 which branches process control to block 192. The center mode provides the capability for the main steering beam to be at its center rotational position. Upon selection of the center mode, the message "centering" is scrolled across the display 130 and the tilt potentiometer is read in to determine the position of the steering mechanism, as illustrated at block 194. The steering pivot beam 52 is then moved to the center position by activating the motor 62 as indicated at block 196. During the centering mode the system processor continually monitors for key-closures. The center mode may be interrupted at any time upon selection of the manual mode by depression of the manual key 144. When the centering function has been completed a message "centered" will flash on the readout 130 and the system, if configured to do so, will automatically return to manual mode. The auto mode, however, cannot be selected until the center mode has finished its centering function.

Upon system power up the system processor checks the PZ switch. If the PZ switch is depressed upon power up the system reinitializes all programmable parameters. If the PZ switch is not depressed on power up, these parameters will remain at the settings that existed on the previous operation.

A maintenance mode is provided so that an operator or maintenance personnel can change parameters and press variable data within the system. This mode is entered at block 200 by activating a internal switch located behind any one of the control panels 26, 28. The maintenance mode may be entered while in either the manual mode or in the auto mode. If entered while the auto mode is in progress, all auto mode functions will proceed normally although normal displays will be inhibited at the remote units involved. Once implemented, a message "maintenance mode" will scroll across the readout 130 and front panel keys become alternate function keys. In addition, all other remote stations connected to the same control circuitry 24 will display "REM * OFF" on the readout 130. This indicates to the operator that the front panel keys in the readout are disabled at that remote panel due to the maintenance mode being selected at one of the other control panels.

Once the system 20 is in the maintenance mode as indicated at block 200 of FIG. 6 and the other remotes are blocked out, three areas of maintenance operation may be selected using the PGM key 136. Once within a selected area of operation, variables to be programmed within each area are accessed using the SEL key 138. The three maintenance mode areas of operation are defined at the user variable area illustrated at block 202, the user switch area illustrated at block 204 and the address/data area illustrated at block 206. The user variable area is entered upon selection of the maintenance mode, the user switches area is selected by depressing the PGM key after entering the maintenance mode, and the address/data area is selected by depressing the PGM key a second time.

The variables within the user variable area which are selectable are accessed by successive depressions of the SEL key 138. The variables that can be controlled are the speed of the correction motor in the auto mode; the gain and offset of the operator edge sensor; the gain and offset of the gear edge sensor; the paster feedback caution trip point in the operator direction; the paster feedback caution trip point in the gear position; the pulse time on and wait time of the paster feedback signal; and the width between the edge sensors in both inches and any fractional component. The values corresponding to these variables are increased using the gear key 142 and decreased using the open key 140.

The first variable which may be selected is the correction motor speed in the auto mode and the speed number is displayed on the display and is increased and decreased, if a change is desired, by using the open and gear keys 140, 142. By depressing the select key 138 the operator may access the operator sensor gain which is the gain of the amplifiers which amplify the output signal of the edge sensor of the operator side. In this status the display will display the gain value and the value can be changed by using the open and gear keys 140, 142. This permits the operator or maintenance personnel to increase the gain if the gain or output of the edge sensor is low. By depressing the select key 138 again the operator may access the operator edge sensor offset variable which permits the edge sensor offset gain to be changed. This value is a multiplier which is used to equalize the sensor signal input to the control circuitry to permit the signal levels to be maintained at a desired level. The next variables which may be selected is the gear scanner gain and the gear scanner offset which are comparable values to the operators scanner gain and offset discussed above.

The next variables which may be selected in order are the operator caution trip point for the paster feedback and the gear caution trip point for the paster feedback, which is entered in tilt percent. The paster feedback signal is a conventional feedback signal in web printing press systems which allows the system to adjust the press roll stand by generating a signal (paster feedback signal) which moves the roll stand slightly in the event that it is biased to one side. Thus, if the steering pivot beam is tilted beyond the caution trip point in one direction or the other a paster feedback signal is generated which moves the roll stand slightly to correct for the excessive bias in one direction. The next variable which may be selected is the pulse on time for the paster feedback signal which determines how much movement of the roll stand is accomplished when a paster feedback signal is generated. The next variable which may be selected is the wait time for the paster feedback signal which is the amount of time which the system will disable the paster feedback pulse before another pulse can be generated. This is the time needed to permit a determination of the result of the previous paster feedback signal.

To switch to the second area of operation of the maintenance mode illustrated by block 204 of FIG. 6, the user switch area, a depression of the PGM key 136 is utilized. The various switch selections within this area are also accessed by successive depressions of the SEL key 138 and the user selects a state of either on or off for each switch condition. These conditions include center mode to manual mode inhibit; interlock ignore in auto mode, edge sensor retract inhibit on interlock out, edge sensor permanent position enable, edge sensor retract upon powerup inhibit, edge sensor web tracking with servo system off enable, auto center potentiometer automatic gain calibration enable, and disabling of the centering of the main steering beam on interlock out. To set the switches to their desired state the operator depresses the gear key 142 for the ON state and depresses the open key 140 for the OFF condition.

The first switch selection available upon entering the user switch area is the center mode to manual mode inhibit. 10 When this switch setting is ON the center mode will not exit to the manual mode automatically, while if it is set in OFF center mode will automatically exit to the manual mode when completed. The next switch option is selected by depressing the SEL key 138 (as are all subsequent switch selections) and is the interlock ignore with the auto mode on. If this switch is set in the ON condition the interlock dropout will be ignored in the auto mode, and if OFF the interlock dropout in the auto mode will result in stopping correction and withdrawal of the edge sensors as described hereinbefore. The next switch selection is the edge sensor retract inhibit in which the ON condition results in the edge sensors retracting on an interlock dropout, while the OFF condition results in no retraction of the edge sensors upon interlock dropout. The next switch selection allows the edge sensors to stay in position and ignore the interlock dropout if in the ON position, and if set to OFF, the edge sensors will locate two inches from the web after interlock dropout and wait for the interlock to return. The next switch selection, if in the ON position, results in the edge sensors going to two inches from the web upon interlock dropout and waiting for interlock return, and then upon interlock return the scanners go to the predetermined web position automatically without searching for the web. If the switch is set to OFF, the scanners will go to the two inch position upon interlock dropout, and then after the interlock returns will search for the web and move the edge sensors to the detected position of the web.

The next switch selection if in the ON position causes the edge sensors to not retract when going through the sequence from the auto mode to the manual mode to power off then back to power on and back to auto mode. If this switch is set in the OFF position then normal operation will occur in which the scanners retract when power is turned off. Thus, in the ON position the switch allows the system to be turned off and then on again from the auto mode back into the auto mode without the scanners retracting. This switch setting resets to OFF after one cycle of operation. The next switch setting when set to ON causes the edge sensors to track to web edge only when in the auto mode but disables the servo system, and when set to OFF operates the auto mode in normal operation.

The next switch selection when set to ON provides a center mode automatic gain calibration of the steering mechanism. This automatic calibration mode causes the system to cycle the steering pivot beam 52 to each extreme of angular development (tilt) and measures the output of the steering beam tilt potentiometer 78 thereby permitting self calibration of the tilt potentiometer 78 after which the steering beam returns to center. In the OFF setting the center mode will simply follow normal operation as described hereinbefore. This calibration mode allows an automatic calibration of the tilt potentiometer so that the system can insure that a reading of 99% tilt occurs just before the limit switch is activated. This feature permits accurate setting of caution trip points to be used to activate a paster feedback signal when the steering pivot beam angular displacement exceeds the caution trip points. The last switch setting if in the ON position disables centering of the steering pivot beam 52 upon interlock dropout when in the auto mode and maintains the steering pivot beam 52 at the position it was at when the interlock dropout occurred. If the switch is put into the OFF state then normal operation will occur wherein the main beam will center upon an interlock dropout. Another option which may be provided is that instead of the steering pivot beam 52 centering upon interlock dropout the steering pivot beam 52 will return to the position it was at a predetermined time (e.g., 20 sec.) prior to the interlock dropout instead of returning to center.

The third area which may be accessed by an additional depression of the PGM key 136 is the address/data area indicated at block 206. This area of operation permits the user to enter a four digit address location ranging from 4828 to 4851 in hexadecimal and includes the ability to specify a two digit hexadecimal data number for each of these locations. Thus, it permits the operator to address memory locations in the system RAM and then enter new data into that location. In this mode, the manual key 144 and auto key 146 function as cursor movements for which digit positions on the readout 130 are manipulated. Thus, the manual key 144 moves the cursor to the right and the auto key 146 moves the cursor to the left. The desired digit position to be changed will blink. To implement the data and address location displayed in the readout, depression of the SEL key 138 is required. Successive depressions of the PGM key 136 will rotate back through the three areas indicated at blocks 102, 104 and 106.

The operator may exit the maintenance mode at any time by turning off the maintenance mode switch. The system 20 will return to the mode that it was in prior to entering the maintenance mode and other remotes will change the readout from "REM*OFF" to the normal display for the mode being re-entered. The mode in progress will proceed until input from the operator changes the mode.

Referring to FIG. 7, there is shown a detailed block diagram illustrating a specific embodiment of the control circuitry 24 utilizing a microprocessor 210 (e.g., a Z-80 in the illustrated embodiment) to provide control processing. The programming for the microprocessor 210 is stored in a program memory 212 comprising a programmable read only memory (PROM) coupled to the processor 210 via a bus 214, as shown. The microprocessor 210 is coupled to support peripheral circuitry via a main bus 216.

Coupled to the microprocessor 210 via the bus 216 is an input port interface 218 having an interlock signal input, a gear limit switch input 298, an operator limit switch input 296, an operator end of travel input and gear end of travel input, as shown. A stepper motor controller and driver 220 is coupled to the microprocessor 210 via the bus 216 having drive outputs for the operator edge sensor motor and for the gear edge sensor motor. An output port interface 222 provides an output interface with outputs to 10 the operator paster feedback relay and the gear paster feedback relay, as well as the manual move signals 292, 294 for both the operator and gear side and an interlock signal 290. A timer/counter circuit 224 is coupled to the bus 216 and includes a clock 226 coupled thereto. A signal from the clock 226 is coupled to the infrared LEDs 228 to provide the two kilohertz modulation signal to the edge sensor infrared generating LEDs. A random access memory 230 (RAM) which serves as a data memory for storage of operational data for the microprocessor 210 is coupled to the bus 216, as shown. An analog to digital (A/D) converter 232 is coupled to the bus 216 directly as well as through a chip select decoder 234 which provides select signals to the A/D converter under the control of the microprocessor 210. An analog multiplexer 236 provides a multiplexed input to the A/D converter permitting the tilt potentiometer, tachometer, operator scan sensor, and gear scan sensor inputs to be multiplexed into the A/D converter.

Also coupled to the microprocessor 210 via the bus 216 is a dual channel UART communications port 240 which provides full duplex serial communications with the remote control panels 26 via a transmit and a receive line, as shown. In addition, the communications port provides for the input of the PZ switch input as well as an auxiliary data communications port 242, as shown. In addition, a series of multiplier circuits 244, 246, 248 are coupled to the microprocessor 210 via the bus 216. The multiplier 244 permits a microprocessor controlled multiplication of the gear edge sensor signal, and the multiplier 246 permits a similar multiplication of the operator edge sensor signal. The output signals from these two multipliers 244, 246 is differenced in a differential amplifier 247 and coupled to the third multiplier 248, the output of which is coupled directly to a motor control circuit 250 via conductor 304, as shown. This multiplier structure permits the microprocessor 210 to control the gain of the sensor amplification channels. Also coupled to the motor control circuit 250 are the operator limit switch signal 306, gear limit switch signals 308, the interlock signal 290, the correction motor tachometer signal 302, the manual move signals 292, 294 for both the gear and operator side, and gear and operator limit signals 298, 296, as shown. The output of the motor control circuit 250 is the correction motor servo signal, which is used to drive the steering pivot beam 52. The motor control circuit 250 is shown in detail in the schematic diagram of FIG. 9.

In operation, the motor control circuit 250 utilizes the input signal from the multiplier 248 to control the servo motor. The signal from the multiplier 248 is a modified signal from the edge sensors which has had the signal from the edge sensors adjusted in gained by the multipliers 246 and 244, after which the difference between the two is obtained via the differential amplifier 247, and then the resulting offset error voltage is amplified by the multiplier 248 and coupled to the motor control 250. This error voltage is used by the circuitry 252 in closed loop with the tachometer value from the correction motor. The gain of the amplifier is controlled by the value of the motor speed variable which is set within the maintenance mode. The motor control circuit is thus always attempting to drive the correction motor from the error voltage detected. The tachometer value in the motor is fed back to the motor control circuit in closed loop from the correction motor. The speed of the tachometer thus makes the motor control change its output voltage by speeding up or slowing down until a balance between the error voltage and the feedback voltage is obtained. This results in a speed of correction which effects the movement of the steering mechanism in the direction opposite the error, resulting in a change in the error voltage which approaches zero caused by moving the web back to the zero position in the edge sensor.

As can be seen from inspection of the control circuit 24, the tilt potentiometer input signal is required for correct operation of the system. This potentiometer 10 monitors the relative position of the steering pivot beam for functions such as center mode and tilt percent display modes. The signal from this potentiometer is processed so that the error voltage is the rotational deviation from the zero point of the potentiometer. In the center mode, this signal becomes closed loop with the motor tachometer feedback circuitry.

FIG. 8 is a detailed block diagram illustrating a specific embodiment of the control panel circuitry 260, including a control microcomputer (e.g., an 8031) coupled to a main bus 262, as shown. Coupled to the microcomputer 264 via the main bus 262 is the eight character display 266 and the front panel LED indicators 268. The front panel LED indicators are coupled to the bus 262 through a LED driver 269, as shown. The eight character display 266 is coupled to the microcomputer 264 via the bus 262 through a buffer circuit 270 and an LED display driver circuit 272, as shown. Also coupled to the LED display driver 272 is a chip select decode circuit 274, which is coupled directly to the microcomputer 264, as shown. In addition, the seven panel control keys are coupled directly to inputs of the microcomputer 262, as well as a direct input from the maintenance switch 276, as shown. A program listing for a program to operate the processor (8031) of the illustrated embodiment is provided in Appendix B.

The control panel circuitry 260 communicates directly with the control circuitry 24 through the communications port 240 of FIG. 7 via receiving line 278 and transmit line 280. A communications between the control circuitry 24 and the control panel circuitry 260 is serial communication using a serial protocol wherein multiple control panels may be coupled in parallel to the control circuitry 24.

The serial protocol uses a twelve byte block to transmit data with each byte composed of an eleven bit byte. Each message block is composed of a beginning byte, ten message bytes and an end byte. The remote first detects the beginning byte which alerts it to the arrival of a message after which the next eight bytes contain message information followed by a ninth byte which holds the LED display values and a tenth byte, the maintenance byte, which informs the remote if the system is in the maintenance mode. Each closure of a key is transmitted from the control panel to the control circuitry five times and the control circuitry counts the transmissions to verify a true key closure. Each byte is composed of a start bit followed by eight data bits, a parity bit and a stop bit. This serial protocol provides for reliable transmission, together with the capability for multiple remote control panels.

Specific embodiments of novel methods and apparatus for automatic web guidance has been described for the purposes of illustrating the manner in which the invention may be used and made. It should be understood that the implementation of other variations and modifications of the invention in its various aspects will be apparent to those skilled in art, and that the invention is not limited by the specific embodiments described. It is therefore contemplated to cover by the present invention any and all modifications, variations, or equivalents that fall within true spirit and scope of the basic underlying principles disclosed and claimed herein.

APPENDIX A

```
:0F0000000100003E4B10FE0D20FB3D20FB1B6163
:03000800C36900C9
:03001000C36900C1
:03001B00C36900B9
:03002000C36900B1
:03002800C36900A9
:03003000C30308FF
:03003800C3690099
:10006600C369002A004323220043F3ED56C3000868
:03007600B01006E
:06080000C30B08C32A101F
:050806000000000000ED
:10080B00F3ED5631 5E40CDDDCFCD1D09CDFF0BCD88
:10081B00AC1006012100FEDB10E601200E237CB597
:10082B0029F510F03E01CDDCCD1B2006012100FE55
:10083B00DB10E601281523 7CB520F510F03E01CD29
:10084B00DC0D2A0E4523220E4513000C30C103E0169
:10085B00D310F3ED562E00DB10E601203C0C060125
:10086B0021C0FFDB10E601201D2E5C5CD6B0BCD9443
:10087B001DC1E1237DB420EB10E63E01CDDC0D3E26
:10088B007B320B45 1B443A0B45A7280B3D320B45F0
:10089B0020021B003E01CDC500CDDDCFCD2B0FCD4B
:1008AB004F0F06012100FFDB10E601281BE5C5CD6F
:1008BB0066B0CD941DC1E1237DB520EB10E63E0105
:1008CB00CDDCDD1B053E01CDC50D3EB0D310C356B2
:0408DB0008F71BFD05
:1008DF0006501C100FBE1DE91EB31BFB140000000EC
:1008EF0000C2409A4012413A416241B4410000000E1
:1008FF0000010101010101000010101010201 00DC
:09090F0000000000000000000000DF
:05091B0000000000000A
:10091D00AF322B453E04324E42DB4E604C03EFF2F
:10092D0032B45210C4211014236000 1FE05ED B08A
:10093D0021C4B11014B36000 1FE17ED B021100BC2
:10094D0011C04B015300ED5021B4B222546110021
:10095D004B21020B06057EB7 2B064F1AED79132 3A1
:10096D0010F43E043221 46D3AB3E02322046210720
:10097D0008224B423E09224D423E05324E423E461F
:10098D001E05CDE10C227746 3E461E05CDE10C221B
:10099D002C463EFF322B453A094B11EB03CDF10CA8
:1009AD0016002260 46ED53B2463A044B11401FCDAB
:1009BD00F10C6B3110000224546ED534746114 57D
:1009CD0046216046CD840D2A6046ED5B6246CB3AEA
:1009DD00CB1BCB1CCB1D224546ED534746 3A404B19
:1009ED0011F401CDF10C1600224746ED534B462171
:1009FD0000000224F462A4146CB3CCB1D224D4611CB
:100A0D004D46214746CD840D1147462146 46CD8F90
:100A1D000D2A454611EB03CD440D7DE728013D3221
:100A2D006446473A434BCB7F2006B8B3B0B78180800
:100A3D00ED44B5B9037 8ED44B243 4BCB7F2802EDBE
:100A4D004411EB03CDF10CED5B4444BCB7A2807E562
:100A5D0021000 0ED52D1191100000224D46ED534FEA
:100A6D0046214946114546CD4B0D2151461145460E
:100A7D00CDAB0D2145461142 46CD840D2149461175
:100A8D004D46CD8F0DED5B454621A9B3CD190D3A10
:100A9D004746B72806CB01A9B309EBED534546ED13
:100AAD005B494621A9B3CD190D3A4B46B72806EB74
:100ABD0001A9B309EB2A4546 2A434847 3A4548B0D0
:100ACD00CB7F2809ED53B4622 3D461B07223B4676
:100ADD00ED53D46ED5B5 14621A9B3CD190D3A539A
:100AED0046B7EB2804 01A9B309 11F40119CB25CBD5
:100AFD0014223F46C9A4A0A1A2A3535953544 54D56
:0E0B0D002050DA55AAA5AAA5202040402931B3
:020B30001400AF
:100B380002383804000344 01E103C0300BB0200C9
:100B4B003C1405041B634001260000000000010064C
:0B0B5800FF0504 23C5520604 04B07057
:050B630000000000000ED
:100B6B003A0745CB7F203D2A0045EB3A0745E67F0B
:100B7B0032003C2A02453A044586320445AF320029
:100BB8003C231B7AB32B021B423A0445A7C234 2C06
```

```
:100B98003E02CDC50D3A054SF53A400C57F1BAFA73
:100BAB00050C1B532A0C45E32A02453A0745E67F0B
:100BBB0032003C4EAF77BE201A3EFF77BEC2DB0B39
:100BCB0071AF32003C231B7AB3281FZ20245EB2267
:100BDB000045C971AF32003CE5D53E04320445CD2D
:100BEB00DC0D3A0545320D1E11BAE3A0445A720A5EC
:100BFB003E04CDC50D1B9E3E0132400CAF5F160075
:100C0B003C320545 7B03223E5F2141C191E005EDE
:100C1B002EB2202245E1E005E237AB7CA9D0EE45
:100C2B002200451A320745AF320445C93E02CDDCE1
:100C3B000D3A0545DDC3A0C0B0940408000100001047
:100C4B001000201000S0200040200000200080207C
:040C5B0001A02001D6
:100C5C00CDC50CF57BCDC7005FF1C5CDE100C10C3E
:100C6CDCCD5EB21000A7ED52D1C9DC500CDCF1D
:100C7C000CC5CDF100C10CCCD6D00CE0098BFC9F9
:100CBC00DC500EBCDCF0CEBC5CD410DC36A0CCD56
:100C9C00CDCCEBCDCF0CEBC5CD190DC10CCCCDBD72
:100CAC000CE5210000ED52EBE1C9CDCCEBCDCF25
:100CBC000CEBC5CD440DC36A0C0EFEA7F0ED440C35
:100CCC00C90EFEF57AA7F2DF0CE5210000A7ED5264
:100CDC00EBE10CF1C9160021000000B3F3C0119EB00
:100CEC0029EB20F6C9260026C4440B3FF53006A707
:100CFC00ED5A79B94FEBA7EB6AEB7BBF47F120EA24
:100D0C0059C9E5DF10C01A7ED44D01CC901000EB1
:100D1C00C5D9D1626A29CE3AC81E300DE5D9C10903
:100D2C00D9C5D9C1EBED4A2B09ED6AC811CB107B10
:100D3C00E220E3D9C9F16007BE2CA7D0D01010058
:100D4C007AA7FA5E0DC3210B100B23CB121BF1E594
:100D5C00210000E3E5A7ED52D46D0DE3E1E309EBD1
:100D6C00E5E1CB34CB1B0B0B0B197BB129E6EBE1E4
:060D7C00C921FFFF11FFFFC9AF
:100D8400060471A8E77231310F9C906042E5521A2
:100D9400094 50E01E71A2F8977 0E0013231 0F6C157
:100DA400E1110945D0D4C906041A7713231 0FAC988
:0E0DB400E15E2356E76F26001952056EBE999
:030DC2001801FF16
:100DC5003A1145E7280 52DD211450021 0D45CDF6EF
:100DD5000D7B2F4EA77C9CDF60D210D453A104554
:100DE500A0AB8677 3EFF321145 2A0E45 23220E45AF
:0A0DF500C906013DF8C3E201BF923
:050DFF000000000000EF
:100E0400DBB9CB472010 3A074 33D320743B7C03246
:100E140003433A4F42FE6B004F3E00324F42C39DE7
:100E24000EC93A2E4B3207 4 3DBEB4F3A4F42FE6BD5
:100E3400200 83E00324F420306 0F3AFF0DFEFF2048
:100E44000D3E0032FF0DDD210050DD22000E3AFFB1
:100E54000D3C32FF0DD5ED5B000E791213ED5300FE
:100E64000ED13A0543E92B177932054 3FE6B2007A5
:100E74003E04320443B7C93A2D4 832044 3B7C93A51
:100E84000443DD32044 3B7C03E0132044379FE6853
:100E94002007324F4232044 3C979FE4B20073A50B2
:100EA40042FE01205F79E660FE602B073E00325072
:100EB400421B053E0132 5C423A0343B9202E3A0209
:100EC4004 33D3202432 03DD3A454232024347 3A44CD
:100ED400423D3244422027 3A504E3F2020F7BCBC0
:100EE4003F3245423A4 842324442 1B123A45A2326C
:100EF4000243 3A474232454 23A4B4232444279 3206
:060F04000034337C9B7C921
:050F0A0000000000000E2
:100F0F00F7CD040E3CFAE67F1E41B3BF31E69BBE6
:07 0F1F0030EE324942 1B5 9EF
:050F260000000000000E6
:100F2B0021A90F7E2347 4E235E2356231AED7910FA
:100F3B00F5C921C50F7E2347 4E235E2356 23ED7B3B
:100F4B001210F5C921214535F036753A0643EE10DE
:100F5B00EA1032064 3D3EC21 2345112245060 80E39
:100F6B00FE7EA72806 3520031AA11 2223CB0110F110
:100F7B00C9E17E23A72001E94F06005E2356 23D544
:100F8B005E2356 23E3ED801BCBE37E23A72002D1BE
:100F9B00E94F06005E2356 23E3ED3DC3940F031114
:100FAB00004712014712024700000000000000029
:100FBB0000000000000000000000000310034712043
:0D0FC3004713054700000000000000000073
:050FD800000000000014
:100FDD003A2F4B324642 3A304B0247423A314B3247
:100FED004B4236003 24F420D521D3E10D38A3E053F
:0F0FFD00D38A3E4 3D3E3B3E7D3BD3E3BD3890921
:10100C003E28D3E3EFD3E8D3E3AF3209443 20A83
:10101C0044 3E8D3310D21C3443A2F0818 3DAF3213
:10102C00003CED73D244 3A0244ED73D0044D0E1DD13
:10103C0075000D7401 3E0E03E3D3EE3E5FD3EE3572170
:10104C06FFFFB7ED52ED5E0944220944 37ED52DDC9
:10105C0075300D7431110D7FB7ED52FA8B10003A23
:10106C00304 2DD7720 3A0444 3D2 3DD2 3DD2000CAFF4
:10107C00D3103230423 2D003C3590 5D0 3510 20EB21
:10108C0032044 4DD7E11DD7710DDE5ED730044DDC7
:10109C006E00DD6601F9DD7E2032304232003C0943
:1010AC00ED730544 3ADF0847DD21F00EFD21E00827
:1010BC00110B44DD6E00DD23DD66 00DD23FF9FD6ED2
:1010CC0000FD23FD6600FD23E5ED730744 2A074 46C
:1010DC007D12137C1213 1003 3ADF0847DD21000987
:1010EC00FD210809111B44DD7E00DD23121 3FD7E5A
:1010FC0000FD23121310F03ADF0847DD211009110F
:1011CC002B44DD7E00DD23121313 10F6ED7B05441A
:01111C000C909
:06111D0000000000000CC
:1011230003E0332314 8F7F73E3032 0047F73E3F3257
:1011330000047F73A2948D315D319F7F73A2948D384
:1011430014D318F7F73A2A4 8D314D318F7F73A2B0E
:1011530048D314D318F7F73A2C4 8D314D318B062 0C
:1011630C5F7C110FE3A2C4 8CB6F2016 3E4ED3156E
```

```
:10117300D319AF6F672323462234446AF323646323 6
:1011E3003746AF323146C93A3146CB472803F71BC1
:10119300F63A3146F6013231460D3D13CD9F143E2A
:1011A3004BD315AF3236462 1FFFFE51B5E3A3146B1
:1011B300CB4F2803F71BF63A3146F6023323146CDC3
:1011C300A413CD3714CE4BD319AF3237462 1FFFFDB
:1011D300E5C3631 23A3146CB472803F71BF63A3191
:1011E30046F6013231146E5CD3D13E1E53EFFBD2034
:1011F30003BC2808ED5323461922324 6E12BE5CDC9
:101203009F143E43D3153E01323646CD9F14E1E58C
:101213007DD314CD9F14E17CD314CD9F14AFD3148D
:101223003A3146CB3732314 6C93A3146CB4F280350
:10123300F71BF63A3146F6023231 46E5CDA413E10A
:10124300E53EFFBD2003E C2808ED5B3446 1922 3479
:10125300 46E12BE5CD3714 3E43D3193E0132374661
:10126300CD3714E1E57D3 31 2CD3714E17CD31BCD08
:10127300B714AFD31B3A3146CBF3231 46C93A311E
:10128300 46CB472803F71BF63A3146F6013231 4682
:10129300CDE914C43D133E42D3152A3246232232EC
:1012A300463E01323646C3231 23A3146CB4F28031A
:1012B300F71BF63A3146F6023231 46CDEE14C4449D
:1012C300133E42D3192A3446 2322344 63E01323791
:1012D30046C37B123A3146CB472803F71BF63A311A
:1012E30046F6013231 46CDE914C43D133E4AD315C7
:1012F3002A3246 2E2232346AF323646C323123A31C4
:1012F3002A3246 2E2232346AF323646C323123A31C4
:1013030046CB4F28C3F71BF63A3146F6023231 46FB
:10131300CDEE14C4441 33E4AD3192A3446 2B2234E7
:1013230046AF323746C37B123A3146CB472803F7E4
:101333001BF63A3146F6013231 46CDE91428 3FCD4D
:101343009F143E41D315CD9F14CDE91420FB3EB35D
:10135300D315CDC514DB145FD5CDC514DB14D1571C
:10136300D5CDC514DB143A3646CB47E1232807EB2A
:10137300210000B7ED52ED5B3246 1922324 63A03A3
:10138300 47CB5FCA2312210000 2232346C323123AFD
:10139300 3146CB4F2803F71BF63A3146F6022317D
:1013A300 46CDEE1428 3FCDE7143E41D319CDE71423
:1013B300CDEE1428 2FB3EB3D319CDD714DB1B5FD5E7
:1013C300CDD714DB1ED157D5CDD714DB1B3A374610
:1013D300CB47E1232807EB21000037ED52ED5B3447
:1013E300461922344 63A0347CB67CA7B1221000 0D4
:1013F300 2234463 7B123A3146CB472803F71BF63E
:10140300 3A3146F6013231 46CDD3D132A3246ED5B1
:10141300 3A4BED5 23007EDB3B3246210000 22324656
:10142300 1BED5 3454 6CD9F143E4BD315CD9F143A2E
:10143300 4546D314CD9F143A4646D314CD9F14AFD3
:10144300D314AF323646C323123A3146CB4F280367
:10145300F71BF63A3146F6023231 46CDA413 2A3450
:10146300 46ED5B3446ED5 23007ED5B3446210000 10
:10147300 2234461BED5 3454 6CDE7143E4BD319CD0D
:1014B300 57143A454 6CD31BCDE7143A4646D31BCDCB
```

```
:10149300B714AFD31BAF323746C37B1206000C5F777
:1014A300C1DB15CB4FCB10F63E02323646 3A010075
:1014B300321B46C9060 0C5F7C1DB19CB4FCB10F66E
:1014C3001BE6060 0C5F7C1DB15CB5720F7CB47CD9D
:1014D30010F21B2406 0 0C5F7C1DB19CB5720F7CBA0
:1014E30047C010F21B C2DB15CB57C9DB19CB57C95C
:0514F300000000000 0F4
:1014F800AF323646 3223946F73A3E46CB4F2B3BAFF9
:1015080032394632364 3A0147E6EF32 0147 3A2047
:1015180048CB6F2006CDBA11CDBD11AF326B462A6C
:1015280051 4822 6946 3A5F46CB7F28021B0EB726F7
:1015380009E60F322146AF325F46D6BE3A2046FE5A
:1015480002280706 0EB72B0206B03A3946A0BE20BC
:10155800 1A3A3646CBFF323946 3A3446B7200C2A70
:1015680032462241462A3446 2243462A1D462B2229
:10157800 1D46CB453A3946 2B3FCB3FCB3FCB3FCB17
:1015880 03FE607CDB40DA515E607CDB40D9715E305
:1015980015 2217D7172B19ED19341A601BB3157C40
:1015A80017501B961907 1A341A601B3A3546CB47D1
:1015BB0C2011 6AF326546CD9140 2FF140DEE1450
:1015CB00C2FF143A5 46B7202 02469462B2269469A
:1015D8007DB40 2FF1421140 0CD7112114 00CD2CE5
:1015EB00123E01326946C3FF140D2311AF326B465C
:1015FB002A5 1422269 46C3FF143A3A46B73A394B4D
:1016080020033A4B 3322F46323D463A2048E642C9
:10161B00200DCB6FC257193A0347CB6FC2AC163AAD
:10162B00204BEA1B2473A4A372B413E6632399F4
:10163B00463A2146CB4F2017CD2B132A4146ED5B66
:10164B00324B7ED5 22B0 53B03CDD7113A2146CB9B
:10165B0047C2FF140D921 32A4346ED5B3446B7EDDB
:10166B0052CAFF14DAFF140D2012C3FF143E1132F4
:10167B0039463A3E46CB 7323B462A3748221D46FB
:10168B003A2146CB4F20 0CCD2B1321FFFFCDD711BC
:10169B003A2146CB47C2FF140D921321FFFFCD2C30
:1016A300 12C3FF143A3A46FE01C2FF143A6546CB0C
:1016B8 0047C2FF140C 7326546 3A2146CB4F202894
:1016C800CD2B1324 4146ED5B3C46B7ED522B16382A
:1016D800143A204 8CB5F200AED5B3A4BED52280 5C2
:1016E8003803CDD7113A2146CB47C2FF140D921308
:1016F8007A4346FD5B3446B7FD5CCAFF14DAFF144D
:10170800 3A204 8CB5FC21C17ED5B3446BD52CAFF3E
:10171800 14DAFF140D2012C3FF143A204 8E64220F5
:10172800 0E3A0347CB6FC22B1A3A1E46FE00201C0C
:10173800 3A1D46FE002015 3A3946CBF7323846CDDA
:10174800 8A11CDBD11AF3239 46C3FF143A2146CBC6
:10175800 4FC2411BE6F0FE40C2411BD3A600DBA6EE
:10176800EEB0CB7FC2411B3A3946C3239 46CD2B00
:10177800 13C3411B3A204BE642200E3A0347CB6FB2
:10178800C22B1A3A1E46FE00201C3A1D46FE002037
:10179800 153A3946CBF7323846CDBA11CDBD11AF5D
:1017A800 3239 46C3FF143A2146CB47C2BA1BE6F08D
```

```
:1017B600FE50C23A1BD3A6003BA6EEB0C37FC23A11
:1017C8001B3A3946C61C3239460D9213C23A1B3A78
:1017D8002048E64220083A0347C36FC223A3A2129
:1017E8004C34FC2411BE4F0FE40C2411BD3A600CE
:1017F800DBA6EE8047C37F2802D444F3A2048C34A
:1018080077202C3A3A46E73A4C4820023A4D4E920
:1018180DA2E13A2F4A3D02F4A20A3A3946C35F
:1018280DF3229461B13A3A4E37D2411BC37E20F6
:1018380050D07121B03D8112A2146E60FF65D3E
:1018480022146D3A8C3FF143A2048E64220083A7A
:1018580047C36FC223A3A2146C347C23A1BE6C8
:1018680F0FE50C23A1BD3A600DBA6EE8047C37FA5
:1018780020202E144F3A2048C3772023A3A46E71E
:1018880A4C4820023A4D4E9D4A71B3A3D4A3D51
:1018980022304820A3A3946C3FF3239461B133AD5
:1018A80036482D23A1BC37E2005D01131B03D24
:1018B00AC123A2146E60FF6403A2146D3A83A3810
:1018C8046C37FCAFF143A2146E60FFE04204A3A6E
:1018D8003446C3472B3C2A3246ED5E3E46ED5223375
:1018E8002A3446D4E3D4E37E4219C37C2C6EE32
:1018F8021000CED52ED5E4E37ED523E14E1017
:1019080323846AF3239463A0147E6EF320147C323
:1019180FF143A3446E372B3C3E3E3239463A91975
:1019280A2048E4220083A0347C36FC223A3A2E
:1019380214C34F200C2A3246ED5E4146E7ED526B
:1019480020F3A3946C3F3239463C37FCAFF143EC7
:1019580030323846E4423239463A2048C3AF3220AE
:1019680043A2146D3A83A0147F6103201470C3FF47
:1019780014C37C3A0347200EE602C2FF14CD0712E2
:1019880C3FF14E604C2FF14CDE112C3FF143A202A
:1019980048E4220083A0347C36FC223A3A214641
:1019A800C3472000C2A3446ED5E4346E7ED52200E3
:1019B8003A3946C3FF3239463C3FF14C37C3A03474A
:1019C8002009EE604C2FF14CD0112C3FF14E602C2C4
:1019D800FF14CD4C12C3FF143A2048C34F2009C3A6D
:1019E8000347C36FC2171A3A2146C34FC2FF142A3E
:1019F8003246ED5E4146E7ED5202791903FF143A3E
:101A0800204C3470C29C1A3A0347C36FCA9C1A3A5C
:101A1800344C3FF323A462A3246224146A3446D3
:101A2800224346A0147E6EF320147A2048C35F66
:101A3800C2621A3A2146C34FCC2133A2146C347EB
:101A4800CC9213C4204BC3572E103A2146C34FCC9A
:101A5800F9133A2146C347CC4C143E5532394463E11
:101A6800203238463A2146E3472B0E3A0147E6EF5F
:101A7B0032014703FF143EFD3A43A2146325F46E2
:101A8B003C6732214603A83A0147E603F6103201F1
:101A9B0047C3FF143A2146C347C2FF142A3446ED08
:101AAB005B4346E7ED52C2C319C3FF143A5F46CB36
:101ABB007F202F372E463A2146FE67C2FD1AD3A6D3
:101ACB0000DBA6EE8020E3A5F463221463A0048D7
:101ADB00D3A43A0147E6EF320147CEA325F46C354
:101AEB005F143D325F46FF143A2146D3A5F32BD
:101AFB005F46C3FF143E6732214603A83A0347CB5B
:101B0800A6FC2FF143A3946CBAF323B463A5F46CBFD
:101B1B007F2806AF325F461B0E372B05E60F32213E
:101B2B00[illegible]
:101B3800CB5FC2571B3A3446CBFF323A462A374862
:101B4800221D463A3A46E73A3948200333A4B4B32BA
:101B5800F463230446C32716A2048E64220083A34
:101B6800034703EFC22B1ACDE914C2FF14CDEE1474
:061B7B00C2FF14C357195F
:051B7E0000000000062
:101B8C003A2B45E7200734E42AF324E42F734E10
:101B9300420B472BFE3E02324E42112020ED53003B
:101BA300446ED530246ED530446ED5306462A4B4297
:101BB3000607CE01110746E5D5C50600EDB0061563B
:101BC300C5F7C134E42CE572805C1D1E11BBE1023
:101BD300EFC1D1E11BC100F3442E2607475C5F3
:101BE3001100460108000EB0061505F7C134E4293
:101BF300CB572805C1E1C3901B10EFC1E12310DED1
:101C0300060700E01E5C5110046480600EDB0C1C543
:101C1300060021431CEDB0061505F7C134E42CB71
:101C2300572805E1E1C3901B10EFC1E1230C10D449
:101C3300E2032004463E4E42CBBF324E42C3901B77
:081C4300202020202020202A219
:051C4B0000000000094
:101C5000CD5F1D2000CD1F1D3A2F4232304E2F71BA5
:101C6000EF2A0442220142FFE012805FED2C2E5EE
:101C7000C1E000CDEB10EFC0EB1C67CDEB1C47CDCD
:101C8000EB1C7B37C2E01C79FE012823FED2C2E0FB
:101C90001C0E06CD051D1E000CDEB1C77231DF9CDC6
:101CA000EB1C7B37C2E01C0E06CD051DC3C91C0EB7
:101CB000002CD051D1E0D4ECD021D2310F97BED4403
:101CC0004FCD051DCE06CD051DC3501C3A0342B76E
:101CD000CBC547D5E5C5F7C110FBE1D1C1C9C1E110
:101CE0000E15CD051DC35E1CC5067B052BF0E5D5E3
:101CF000CD5F1D21E12005CD171D1BCFF5825FF1F4
:101D0000C1C97BB15FDBB1CB572005CD171D1BF5CD
:101D100079D3E3CDC1C9C5D5E5F7E1D1C1C921A3
:101D2000014235C0233500240442220142CE10D36D
:101D3000823E05D3823E43D3E3CE07D3E03E66D346
:101D4000812F0E4222094222074AF3206422320366
:101D5000420921C1C2204423CD0322F421BCB21D1
:101D6000006427EA7281C352A09427E232209421 1F9
:101D70002B42A7ED5220062108422209426F7FFB3
:101D80007C9DBE1F5E4302304E45D3E2F1CB47A0
:101D9000CBDBE3C9210642 7EFE200BCDE21DCB2132
:101DA000064234 2A0742772322074211234 2A7ED2D
:091DB00052C0210E422207420976
:051DB900000000000025
:101DBE0021201C22144221E46CD121EF7CD0A1ED1
:101DCE003A4942FE6329F511C4463E6212130104A91
```

```
:101DDE000021004EE003E651221DA46060C4E2348
:101DEE00CDF51D10F918D5B9C8572005CD041E76
:101DFE001BF579D3EC9C5E5F7E1C1C9211B463568
:101E0E00C0233500A1646221E45F7F7F7F73E10BC
:101E1E00D38AAFD38A3E43D3E83E07D38E3EB8D336
:021E2E0089C960
:101E3000E5470E00D9D3CB275F1600217311EB7ED95
:101E4000524D44E1D9D9DA035F0A0357AFB7ED52A7
:101E5000380303C1BFB19D9B7200BCB4120043E209C
:101E60001B02C63012120EFF10BEC91027EB0364F6
:101E7000000A0001000E5470E00D9D3CB275F1600A0
:101EB00021731EB7ED524D44E1D9D9DA035F0A030D
:101E900057AFB7ED523B033C1BFB19D9C6301213B2
:101EA0000EFF10E6C9FE012E26FE022816FE0328B2
:101EB0000C7CCB3FCB3FCB3FCB3FCDD61E7CE60F40
:101EC000CDD61E7DCB3FCB3FCB3FCB3FCDD61E7D6E
:101ED000E60FCDD61EC9FE0AF2DF1EC6301B02C6B6
:041EE000371213C929
:051EE400000000000F9
:101EE9003E01D21E46AF321C46320147320247 32AD
:101EF9006B46DD21005DDD22E51E3E00 32E41E3A2C
:101F09002F4832446423A304832474 23A314832 48FD
:101F190042 3A2146D3A8110045211BB1F06057EB7C6
:101F29002B064F1AED79132310F4CD23113A2B45C6
:101F3900B72820F73A4E42E60320FB21C01FZ24B6A
:101F49004 2E09324D423E01324E42F73A4E42E696
:101F59000320FB3A1C4647AF373A1B465F1DBB2B7D
:101F69001FCB23DD21A71FDD19DD6E00DD23DD6613
:101F790000117F1FD5E9AF373A1B46321C465F1D3A
:101FB900CB23DD21B11FDD19DD6E00DD23DD660009
:101F9900119E1FD5E9F71B3E3E01321B46C9CF1F59
:101FA900332CE62665221A3E3C2047 2E00279E2238
:101FB900BE3E4A4A1A2A3535953544 54D2050DAFC
:061FC900000000000012
:101FCF003A0846E61BF601320846 3E46320946 3A06
:101FDF002F4832446423A304832474 23A314832 827
:101FEF00423E0232384E3E0432 4E423A0147E6E361
:101FFF00320147 3A2046B7C6050E10280B3DC6065C
:10200F000E0E2904C6C4E1B3A2146E6F0B0322 1D5
:10201F00467 9F601320846AF322446 3E503229 46F3
:10202F00C93A2146 2B07F6C03A322146 3A03475A
:10203F00214722064C34F2009214F2206 20CB57A4
:10204F0028D3A2946 3D322946C2F2D3A2446EE2C
:10205F00FF322446 3E502807 3E29215722060032D3
:10206F002946 3A0846E61BF601B0320846 1B4DD30D
:10207F00A600DBA6EEB0322246 0B7F2B0BED44ED5A
:10208F005B2C461B04ED5B7746CDF10C7BB7200532
:10209F007CFE6336022E6 33A224 6E6B0B4322246 3B
:1020AF00C87F213F22200321 2F22E67FFE05200325
:1020BF00213722 3E3322946AF322A461100460183
:1020CF00090 5DB0B7202 93A224 6E67F26001 1AF
:1020DF000546 3E020D751ED5B0546213 9397ED3C
:1020EF00522E D7A063DFE3B3B20637E3206460C
:1020FF003A0147E6F3320147 3A0846E61BF601324D
:10210F000846 3A4942324 4247AF324942 7B372CED
:10211F00193A0343B7200932 67463A4E4B02664 4A
:10212F00FE462E46FE47CACC21C9FE6528 2ED64156
:10213F00FBFE0BF0CDB4D1F2209 3E02321B46C96E
:10214F003A2046C3AF322046 3E03321B46C93A2003
:10215F0046CBAF322046 3E05321B46C93A2046C306
:10216F00AF322046 3E04321B46C93A2046CBAF3223
:10217F00204E3A0347CB572034 3A0846E61BF62151
:10218F003209 463A6646DD32 6646201 33A6746EEB7
:10219F00FF3267463A4E4928 DD3A4F46326646 3A6E
:1021AF006746B7C03A0147F6 0B320147C93A2A463F
:1021BF00B7C03A0846E61BF6 21320846C93A204811
:1021CF00CBAF322046 3A0347CB4F20343A0846E68C
:1021DF001BF641320B46 3A6646DD326646 20133AB3
:1021EF006746EEFF3267463A4E4928DD3A4F463269
:1021FF006646 3A6746B7C03A0147F6043201147C907
:10220F003A2446B7C034 3546E61BF641320846C998
:10221F004B214721 5D214F214B2172 1CC216B2172
:10222F004F5045522020202 5434E5452020202528
:10223F0047454152202020 254F5020404940494AD
:10224F0047522040494D4954 2020202020202047
:0622 5F0000000000000079
:10226500 3A1C46320946 3A0846321A46AF32084 6B3
:10227500 3E4E320946214E 2622 4E423E21324D42EB
:10228500 3E05324542AF 325546325646 325A46 32F6
:10229500 7346 3A324632 5B46093A4E42E603C2CCEF
:1022A500 2334 5A46B7C29 5232BFF325A46 3A554617
:10223500CDB40DBA22C0221F 23662 33A5646CB273A
:1022C500CB2721772685 6F7CCE0067110046010458
:1022D50000EDB0C3 2012133A5A46210048 56F7C2A
:1022E500CE00677E473A5 46FE022804FE042004C1
:1022F5003A354 3D613EB3 0247777 6B9B62603E45
:10230500 03CD3C1E3A564621C726 256F7CCE006721
:10231500 7EB72 87C4F0BEB791B763A5646CB27CB01
:10232500 2721A326856F7CCE0067110046010400 96
:10233500EDB03A564647CB3FCB3FCB3F2120489 5B2
:10234500 6F7CCE00676E7BE6073C47AF37CB17103A
:10235500FCA5216F2620032173260104 00EDB01B5A
:10236500 2F2A5746110046 3E04CDA51E110446 3EB0
:10237500 2012131213 3A5046F2600 3E02CDA51EAC
:10238500 3A564621004 6856F7CCE00677E325C4614
:10239500 3A5546FE022030 3A5E463D325B46202 7E1
:1023A500 3A324632 5B463A564621004 6856F7CCE26
:1023B500 0067 3E20BE2B0 3A7346FE012 9053E20E4
:1023C500 771B043A5C46 773A4 9423 4A4247AF3277
:1023D500 49427E37CE3E04 324E427BFE48CADA25E3
:1023E500D661FBFEDBF047AF 3273467BCDB40DF6E6
:1023F500 2307242324 0A2446 2481 24 02452 25DAD5
```

```
:1024050025C93A5546FE02C03A5646FE07F03CFE3F
:10241500040218243C3C325446AF325446C93A5593
:10242500466E02C03A5646E37C3C3FE05C236243BB3
:10243500D3D3256464F325446C90010000110000120
:10244500000AF325446325646C3A24E325B463A5522
:10245500463CFE03C801AF325546FE02C02A574EB3
:10246500FE325D463A5546C3FC3270B27CE27EFFD
:10247500300406371B02C63D325446C93A5546E7ED
:10248500201E3A5646C3CFE0E2D5E325446AF325AEB
:10249500446C9AF325646325446C9FE0120103A5451
:1024A500463CFE092EC325646AF325446C93E0133
:1024B500327346245746C3A5D46770C93A5546E7209C
:1024C50023AF325446C3A5646210D226B56F7CCE0036
:1024D500674C3A5646210D46B56F7CCE00677EB3C0
:1024E500CE3C77C9FE0120263A5646470E3FC3F2D
:1024F500CE3F2120463B56F7CCE00674E7BE6073C3D
:10250500474F37CE1710FCE177AF325446C93A56AF
:10251500446FE04F2392C3E27213E24B56F7CCE0063
:10252500675E23562A5746192257467E325D46AFC7
:10253500325446C9D606CE27214224B56F7CCE0068
:10254500673A5D46B6325D46AF325446C93A5546CB
:10255500B72016AF325446C3A5646210048B56F7C59
:10256500CE00677ED601D877C9FE0120273A5646A8
:10257500470E3FC3FC3FC3F2120488B56F7CCE0067C3
:10258500478E6073C47AF37CE1710FC2FA177AF46
:10259500325A46C93A5646FE04F2C125CE27213E7A
:1025A500248B56F7CCE00675E23562A5746B7ED5209
:1025B500225746E325D46AF325446C9D606214273
:1025C500240B27B56F7CCE0673A5D46963225D4603
:1025D500AF325446C93A094811E603CDF10C160045
:1025E500226046ED53E246F73A044811A00FCDF135
:1025F500006C63110000224546ED53A746F7114523
:10260500462160460DE40DCD3C2A3A446E61E3250
:10261500084E3A5946321E46FE023E46320946C036
:10262500385946321C46A46423246423A474E3233
:10263500474234E4E3246423A074E326E463E01D8
:10264500326F463E003272460940414946E44454EA1
:10265500414E434520A4F4445203A4F4654574125
:10266500524520524556203225322204F4E20204FC3
:10267500444A4D4F54D34F5053C74F5053CF4752F3
:10268500503C7475253CF4F5043C1475243C150548C
:10269500A3C157544C1534357C9534357C6414395
:1026A500540D494E54C9534352D453435D0D534348
:1026B500A9D04E525C0F5742545241434C34E4365
:1026C5004FC9A4A0A1A2A3000000000000FFFFFFC6
:0026D500FFFF6363FFFFFF3FFD
:0326DD001B01FFE2
:0426E000000000000000F4
:1026E6003A0B46E61B3D2C54E3C4463209463AF3223D5
:1026F600463ED132294132244C93A4E42E603C2CE
:1027060022253A2346372017341F46B721FD282821
:1027160003210522C110046010B00EDB0C3D9273D61
:1027260020363A2046B706050E10210D2C2B113DFD
:1027360006060ED82115202807060406E1B211D2C46
:1027460032146E6F0B0322146793206461100467B
:1027560001080DEB0C3D9273D202434404B6F2632
:1027660001100463E03CD301E3E203203462A416C
:1027760048110446CD6D2B3E2232074603D9273A6F
:1027860043486B7F2502ED4437201624448B5B407
:1027960003E002000D21252C110046010B00EDB01B41
:1027A600326F2600110046B3C2CD301E3E2C3220219
:1027B600462A4448110346CD6D2E3A4346473A45CD
:1027C6004B3F2D3272122AF2206461B0621224777
:1027D6002206463A2946D3D3229462046D3EF0322915
:1027E600463A2A463D3D2A462032A334B3D22A466B
:1027F6003A2346372135206C2B1521C12B060A0C
:1028060003D280D21C3B2060B3D280521D42B062971
:1028160022343273B3C4423E05324542344942323E
:1028260044247AF324942783B7C87BFE6BCA322A6B
:1028360064BFBF2BFC0DB40D412B5223BF285144
:1028460028C2B02294F29C229322AC93E01321B37
:1028560046E04324242C3CC2A3E02321B463E045A
:1028660032424203CC2A3A2346BFE042001AF3294
:1028760023467E3D2078224624462D5B6246CB3ACBC0
:1028860018CB1CCB1D224546ED534746BA404B110B
:1028960F401CDF10C160022494462D534B46F721C3
:1028A6000000224F462A4146CB3CCB1D224D461103
:1028B6004D4621494CD84DD1149462145460D8FC9
:1028C6000D2445411E5030D4407D87280130D325A
:1028D6004446473443423B7F2009BB3B117B2430B
:1028E6004B1B3BD4433B3B47BD4432434B3B044G
:1028F6003243423C013B2946322A46C93A2346376B
:1029060020123A1F46BD3B21F4621FD2B2B2121B7
:1029160005C1B1C3CC3A2046B2CFE033801AF3253
:1029260020462100202B0921152C3D2B03211D2C7C
:1029360011004601080ED8D3EF032294B3A334B1D
:1029460032244B3C0432424209B3A2346FE02FB2057
:1029560022A4148117D0019E321EB03ED522018F3
:1029660AF5F573A094BD6D2473A404BBB200511A2
:1029760043B31B43C3240BED534148C33E29EDF1
:1029860058444B217D0019E3A434B4F29E297D09
:1029960B42022119FC18DA21EB03ED522016AF47
:1029A6005F573A444473A434BBB200511B8031B07
:1029B6004C3C3243BED534448C33E293A2346FE7D
:1029C60002FB2024244148111E3FF19EB7A2811FB
:1029D6001100C3A4BFE0D2073D3240481163B71
:1029E6003ED534148C33E29ED534448211E3FF195B
:1029F600EB3A434B43529D3A434B4F2202A21BD
:102A06001BFCEB5220F1100003A6446ED44473A87
:102A16004343BB200C1195FC18B3B7A2807116BBC
:102A2600033D3243BED534448C33E293E04321B1E
:102A3600463E04324242246046D5B6246CB3ACBB6
```

```
:102A46001BCB1CCB1D224546ED534746 3A404B1149
:102A5600F401CDF10C16002249 46ED534B46F72101
:102A66000000224F462A414BCB3CCB1D224D461141
:102A76004D46214946CDE4CD1149462146 46CD8F07
:102A86000D2A4546 11EB03CD440D7D572B013D3298
:102A96006446473A4349CB7F2006EB3B0B7B1B0877
:102AA600ED44BB32017BED44324349CB7F2802ED37
:102AB6004411EB03CDF10CED5B444BCB7A2807E5D9
:102AC6002100005D52D11911000022 4D46ED534F61
:102AD60046F72149461145460DAB0D2151461145D4
:102AE60046CDAB0D2145461140460D840D2149 46B7
:102AF600114D46CD9F0CF7ED5B454621A983CD19C6
:102B06000D3A4746B72B06EB01A983 09EBED534575
:102B160046FD5B4946 21A983CD190D3A4B46B72BA8
:102B260006EB01A983 09EB2A4546 3A4348473A454D
:102B36004BB0CB7F2807ED533B46 22D461B072275
:102B46003B46ED533D46ED5B514621A983CD190D1C
:102B56003A5346B7EB2B2401A983 0911F40119CBAE
:102B660025CB14223F46C9CB7C28074D442100000C3
:102B7600ED427D3429 0C017D00 4F3CB7ED42FBC2B2
:102B8600802E47B0B0219A2B B56F7CCE00670103BE
:102B9600000EDB0C9202040312FBE312FB4332FBBA3
:102BA600312FB2D5 2FBB332FB4372FBE2020404499
:102BB600495350 4C415924D4F4445475549444 58A
:102BC600204D4F4445574542205749445448574540
:102BD6004220434542544552 4C494E4520544F20C1
:102BE6005052455352 4345445524C494E4549
:102BF600204F4446534554205449 4C54202520570F
:102C06004542205 04F532204F502045444745 2047CA
:102C16005220454447452022043454544552202 0E6
:072C2600205A4552 4F202007
:062C2D000000000000000A1
:102C33003A0846E1BF6022 2046326D463E4632FB
:102C43000946 3A074E326E463E0132 6F463E003222D
:102C53007046327246 3A094B1EF7CDE10C3EE3CDD7
:102C63004 10D7D323E4 03E003237 4E3A464E3246E5
:102C73004 23A474E3247423446 4E3249 42AF323AEA
:102C8300463A224E6420 2AF203A0347CE6FCAA765
:102C9300202A3E46224146 2A3D46224346 3E0132EB
:102CA3003A461B0E3A0347E6 06C245353A0047E66E
:102CB3000F3200470419 5F7C110FE3A2146CB4F67
:102CC3002022E60FF640 0D3A03EB0D3A1F7D3A60077
:102CD300DBA6EB0F20C2 0EE44E73A0246D3A13EEA
:102CE30010FA512D3A2146 CE472022E60FF650D356
:102CF300A83EB0D3A3F7D3A600DBA6EB0F2052D72
:102D0300ED44E73A044E 0D3A03E0EFA512D3A004 79D
:102D1300F63032004706 0FC5F7C110FE3A2046CB07
:102D2300 5FC2E42D3E 0FC2E42D3A2146CB4FC2D0F4
:102D3300 2E60FF640D3A 03A3546D3A1F7D3A600222
:102D4300DBA6EB0D3A0246 D3A13E10FAD02D326CB6
:102D5300463E0C322946 3A0546322D463A6B463C23
:102D6300326B463A6B46FE0321BF373E1B380521F3
:102D7300AA373E1E224B 4232B4042 3E05324E42F7A7
:102D8300 3A2946 3D322946 2B2D3EB0322946 3A5B
:102D9300 6C46473A0546A032 0E463A4942FE412B5B
:102DA300093 44E42E6032 9E31B5 3E01321B463A3B
:102DB3006D46320B463A2F4B 32464 23A3048324747
:102DC300423A214B324B423E 04324E42093A2144E1
:102DD300CB4720 1DE6DFF650D3A3A354BD3A3F7C7
:102DE300D3A600DB46EEB0D3 A044BD3A3E08F251F3
:102EF3002D3E0132 3B463E0132244 63E04324E42D5
:102E0300AF322346 32A46322546 32B463E0532DE
:102E1300294A2374B2 2B463A344B 706043A3924
:102E2300452005 3A4B4E6 0032F46 3230467B3266
:102E3300 2B46CE2101 3E224B423E09324D423E0505
:102E4300324E42093A 3E46CB6F2907 3A3446B7CA99
:102E5300AD2D3A3B 46CB6F2B2221E6 37224B423E36
:102E6300 0F324D423E 05324E42F73A4942FE41CAC5
:102E7300AD2D3A4E42 E6032BE01E5E3A2346B7C299
:102EB300A5303A3B 46CB7F2B0D3E0132 2346 3EFF1C
:102E9300322946 3E9343A0347211437 0640CB4FBF
:102EA300200A211C 3706 2CCB57CAEA2E3E04324E95
:102EB300423A2946 3D322946 2B1303A2A46EEFF3C
:102EC300322A463E 502B073E2E2164 3706003229 1D
:102ED300463A0944 E61BF602E0320B46110046 01A3
:102EE3000800ED5 0C3E1303A0346E61BF602320 80E
:102EF300463A2546 B7CA192F2144 3711004601081F
.102F030000ED501105466F2600 3E02CD751E3E044E
:102F1300324E42C3 813D3A4542C603C281303A28F0
:102F2300463B7C2972F3A3A46B7CA6B303A0347CB07
:102F3300 6FCA6B03CDE9142031CDEE142 02C3A2924
:102F3300 6FCA6B03CDE9142031CDEE142 02C3A2924
:102F4300463D322946 3C2B1303A2A46EEFF322A464E
:102F5300210C373EA02B 053E502164 3732294611 03
:102F6300004601080 0ED3C3813 03A3446FE012B1D
:102F7300132 1CB372245423E0F324D423E05324E93
:102F8300042C37B303A2946B7CA5630 3D20113A2713
:102F9300463D322946 3C2B1304F322B46 3C381303D99
:102FA3002060 3A4348CB7F2B02ED44B720162A44D9
:102FB30048B5B43E 00200D215C3711004601080 0DE
:102FC300ED3B018326F2600110046 3E02CD301E3E92
:102FD300203202462A4448110346 0D6D2B3A43481A
:102FE300473A4548B0F2B2C21224F220646 1B0E3E
:102FF300212247220646 3EFF322746 3E0132294613
:103003001B7C3D20213A2743 3D322746 2B1302194
:103013000A3822454 23E04324D423E05324E423E70
:103023000232 2946 1B5B3A4046F2600110046 3E9F
:103033000 3CD301E3E2D3D3 0346 0A4148110446 0B3
:103043006D2B3E2 23D2074 43EFF322746 3E0322 28F
:103053004 61B2B217C372245423E 1302 4D423E05 3C
:103063003245421B 1921 6C372245423E 1302 4D423B
:103073003E05324E42AF322A46 3E5032294 63A3856
```

```
:1030B300446B77CA8934210737224B423E0F324D54
:1030C300423E05324E42573A4E42E603C299300C3EE
:1030A3004535FE01CE2333342846FEFF2048E3E047D
:1030B300324E42573A4E42E6032CFB06020C5210497
:1030C300371100460108D0EDD006C0C5F7C110FB73
:1030D300216437110046010800EDD006500C5F70161
:1030E3001CFBC110DB3E0332284623E05322948AFB5
:1030F300322A46C297343A2246CB7F20173A054BF3
:1031030047322246E67FB330233A0147E67C320140
:1031130047C330323A0648473A2246E67FB3D23030
:1031230031340147E67C320147C330323A0648FE60
:1031330000284134BF46FE012B0FB73A7246FEB007
:1031430DA2C32AF327246180B73A7246FE050A00
:1031530028C32AF327246BA8E4647FE002B021D1FE9
:1031630034BF46FE012039AF326F463A0648324E55
:1031730046C29B313A0147F6023201470330327B29
:1031B300326E463A6F46FE012003A0147F6023291
:1031930001470330323A0147E67C320147C330323C
:1031A3003E01326F463A0748326E461B003A0848B8
:1031B300FE002B3F3A6F46FE012B0FB73A7246FED9
:1031C300B0DA2C32AF327246180CB73A7246FE0503
:1031D3003B57AF327246BA8E4647FE002B02101D3A
:1031E3003A6F46FE012035AF326F463A0648324E9
:1031F300461B1F3A0147F6013201471B307B326EFC
:1032030046BA6F46FE012004A0147F6013201476A
:1032130018B3A0147E67C320147B113C013C6F11
:1032230046BA0748326E461BF3C327246BA284621
:1032330032D322E46FE02F29734CB4004132543266A
:1032430045323A2146E60FF67032214603A8C2979A
:1032530343A3C4B322E463A0347211437064CBD8
:1032630042009211C3706200B57293A3A29463DE3
:1032730032294602B934BA46EEFF322A463E057F
:1032B3002807BE022184370460322946BA0646E6FB
:1032930018F6023032B4611004601080EDB0C32B
:1032A3009934BE0532294BAF322A463A2546B72875
:1032B300192144371100460108D0EDB011054466FBE
:1032C300260038020D751EC3973403A4600BA6EEEF
:1032D300B0473A2146E60FF660322146D3A87B327A
:1032E3002B46CB7F2B02EE445F3A3E48CDE1003A82
:1032F3003F4B477C906730022600BA2B46E6B0946D
:1033030032B46064CB7F200226207CB720020BE4
:1033130000BA0B464FE61BF6025F79A02B0F3A2EC6
:1033230046B72B12B0322E46200C060060B7B03291
:1033330006467C322E46DBA0000A6EEB0322461B
:1033430CB7F280BE044EDB32C461B04ED5B7746F4
:1033530CDF10C7B3720057CFE62B0226633A224E
:1033530CDF10C7B3720057CFE62B0226633A224E
:1033630046E6B0B432224BA1F46B72B29213C3725
:1033730011004601080EDB03A2B46062BCB7F28FF
:1033B3000206BDE67F6F2600110446781213BE02D3
:1033F300CD751EC3B9343A2246CB7F21343720037F
:1033A300212437E67FFE0530032120371100460127
:1033B3000800EDB03A2246E67F6F2600110546BE2F
:1033C30002CD751EED5B0546213939B7ED52281044
:1033D3007A0630FE3538020623578320646C3B934EC
:1033E300FE02C24343A2846CB6F2007AF32234630
:1033F300C3B934CDE914200400DEE142005AF322322
:1034030046C93A2546B7291E2144371100460108C
:1034130000EDB011054466F2600BE02CD751EBE0439
:1034230032E42C3B9343A4E42E6030289342108BC
:1034330037224B423E0F324D423E05324E42C3B914
:1034430034FE03C297343A4E42E603C289343A1FFC
:1034530046B7214037280321543711004601080091
:1034630EDB03A2946B0322946C2B9343EF0322FFD
:1034730046BA2446B0322A46C2B9343A334B322ABA
:1034B3004621F537224B423E0C324D423E05324E29
:1034930042C3B9343A3B46CB6F2B1B3E0232234627
:1034A300AF322246BA0147E67C320147BA0646E6FE
:1034B3001BF6022B2B46BA4B4247AF324942783D2
:1034C300203BBA0343B7201532674622254BA4E36
:1034D3004B326646BA0147E6F3320147C9473A2381
:1034E3004B7C03A3A46CB7FC07BFE46CA7036FE2E
:1034F30047CAFC35C9FE6BCAE436D641FBFED8F06F
:1035030000DB40D0B3545351B354E3594350D357048
:1035130036FC35E43A3A346FE03C03A5E46322390
:1035230046BE04324E423E0132294BAF322A463AE3
:1035300046B324E423A4746B324723A4B4B324578
:1035430042C93E0132184BA2F4B324B423A30487E
:1035530032474234A0148324B423A0147E67C320127
:1035630047AF322A46BE503229462C93A2346FE0324
:1035730CCB3E05321B46B4BF4B324B423A304B3258
:1035B3004742BA0148324B423A0147E67C320147E2
:1035F3000C93A2346FE03CB3A2B46B3E4B3E033207
:1035A3002346BE04324E423E0132294B322A463AEF
:1035B3002F4B324B423A304B324742BA0148324B3D
:1035C300423A0147E67C320147C93A2346FE03C02B
:1035D3003A1F46EE01321F46214037280321543748
:1035E3001100460108D0EDB03EF0322946BA334857
:1035F300322A46BE04324E42C93A2346FE03CB3736
:1036030020423A3446CB7F2033BA0347CB4F202B0D
:1036130038B4B2D3B6A6201BBA6746BEFF326706
:1036230046BA4E4B2B03BA4F4B3B6B46BA6746B709
:1036330020093A0147F6043201470C93A0147E6FB3C
:1036430032014703A3B4B473A2546BF03C32254E
:1036530046BA2146CB4F2007BA1146CB2241463A80
:1036B3002146CB47C02A434B2322434BC93A234631
:1036730FE03CB3720423A3A46CB7F2033BA0347B2
:1036B300CB5720233A6646B3B3B6B46B20133A6746AF
:1036B3003A6746B7200B3A0147F6DB320147C93A53
:1036B3000147E6F7B2B147C93A3B4B473A2546BE3C
:1036C300F03C322546BA2146CB4F2007BA1146237B
```

```
:1036D3002241463A2146E47C02443462B22434642
:1036E300C93E0422E463A2F4B324642A3042B2EA
:1036F3004742A314B2243423A0147E67C32014771
:10370300C9204C4F434E4544202524541445920C6
:10371300A04F5020C4494D4954522040494D49E4
:10372300544F504552202020254345522020202F0
:10373300254745415220202025574542202D6E6EB6
:10374300204D4F56452064E2020544494C54202561
:10375300205745422050 4F5320202054455524F2096
:10376300202020202020202020534341 4E4E45522C
:10377300532053454548494EC75343414E4E455243
:10378300532050524553455454494EC75343414E19
:10379300 4E455220641554C5420434C45414E2002
:1037A3005343414E4E45D25343414E4E4552204 61C
:1037B3004155 4C5420434 14C4C204D41494E5441BA
:1037C3004E454E43C542454C4F5720494E544552F2
:1037D3004C4F43CB534545E494E4720544494D45EB
:1037E3004F55D457454220574944544B204552520D7
:1037F3004FD2444953504C4159204D4F44455745AE
:1038D3004220574944544B204F4646534554202 0AC
:01381 3002094
:06381400000000000000AE
:10381A003A0S45E115F604320E463E4432094 63E53
:10382A0002323E46F7F73A0147E6EF320147 3A2003
:10383A004BCB7F2929EFFD3A43A2146E60FF660FB
:10384A0032214 6D3AE3E0E320147322744621E5396F
:10385A00224E423E27324D423E0532 4E42093EFF7E
:10386A00D3A43E67D3AE3A0147E603F610320147CC
:10387A0021CC392245423E0932 4D423E05324E425C
:10388A00C93A204BCB7FCA21393A7446FE0E2042F9
:10389A003A0347E604CA7E39D3A600DBA6EEB0CBFC
:1038AA007F2802ED443275463A75461E0ACDE10C70
:1038BA003E14CD410D7D215014CD410D3E020D4126
:1038CA000D7D1E05CDE10C222C463E043201473205
:1038DA0074463A0347E602CA7E39D3A600DBA6EE4F
:1038EA00BCB7F2802ED443276463A76461E0ACDD0
:1038FA00E10C3E14CD410D7D215014CD410D3E0207
:1039 0A00CD410D7D1E05CDE10C227746 3A2042CBEC
:10391A00BF3220 4BC3E3E3E344E42E6032056060E0
:10392A00C521D539110C4601080CED800650C5F7BA
:10393A00C110FB21DD39110C4601080CED20062B4F
:10394A00C5F7C110FBC110DE3A2C4BCB472025AFF4
:10395A0006054FC5F7C1D3A600DBA6EEB0CB7F28AC
:10396A0002ED44FE002804FE012009 10E63A004850
:10397A00D3A418 2E3A494232 4A4247AF324947 26D2
:10398A00B7CBFE6528D4D441FBFED8F0CDB40D9EBC
:10399A0039AC39AE39AE39AE39AE39AE39AE39C6E1
:1039AA0039C93A0147E6EF3201470604C5F7C1109D
:1039EA00FE3A2146D3AE3E01321B46C93E04321B3C
:1039CA0046C943454E544552494E C743454E544550
:1039DA005245C420202020202020AD43414C4942A7
:1039EA005241544944E4720544494C542047414 94E6C
:1039FA00205041524144554455253202B41435 0ED
:023A0A0047A9CA
:00000001FF
```

APPENDIX B

```
MCS-51 MACRO ASSEMBLER   REMV3

ISIS-II MCS-51 MACRO ASSEMBLER V2.1
OBJECT MODULE PLACED IN :F0:REMV3.OBJ
ASSEMBLER INVOKED BY:  ASM51 REMV3.MAC

LOC  OBJ

0020              17    BIT0    EQU    20H
0032              18    MESS0   EQU    32H
0033              19    MESS1   EQU    33H
0034              20    MESS2   EQU    34H
0035              21    MESS3   EQU    35H
0036              22    MESS4   EQU    36H
0037              23    MESS5   EQU    37H
0038              24    MESS6   EQU    38H
0039              25    MESS7   EQU    39H
003A              26    MESS8   EQU    3AH
003B              27    MESS9   EQU    3BH
003C              28    TIME    EQU    3CH
003D              29    LCHMSD  EQU    3DH
```

© 1987, 1988 Web Printing Controls Co., Inc.
All Rights Reserved

```
LOC  OBJ          LINE    SOURCE

003E              30      LCHLSD  EQU     3EH
003F              31      KEYM    EQU     3FH
0040              32      DSPLYM  EQU     40H
0007              33      STCK    EQU     07H     ;                       003
008D              34      RELOAD  EQU     8DH
                  35      ;*****************************************************
                  36      ;***
                  37      ;***
                  38      ;***
                  39      ;*****************************************************
00FF              40      PAUSE1  EQU     0FFH
00FF              41      PAUSE2  EQU     0FFH
0040              42      DELAY   EQU     40H
00FF              43      XLNGTH  EQU     0FFH
                  44      ;*****************************************************
                  45      ;
                  46      ;-----------------------------------------------------
0000              47              ORG     00H
                  48      ;-----------------------------------------------------
0000 020050       49      START:  LJMP    INITL
                  50      ;*****************************************************
                  51      ;***
                  52      ;***
                  53      ;***
                  54      ;*****************************************************
                  55      ;
                  56      ;-----------------------------------------------------
0023              57              ORG     023H
                  58      ;-----------------------------------------------------
0023 02021A       59      SERPRT: LJMP    INTRPT          ;  JUMP TO RECEIVE MESSAGES
                  60      ;*****************************************************
                  61      ;***
                  62      ;***
                  63      ;***
                  64      ;*****************************************************
                  65      ;
                  66      ;-----------------------------------------------------
0050              67              ORG     50H
                  68      ;-----------------------------------------------------
0050 758DF4       69      INITL:  MOV     RELOAD,#0F4H    ;
0053 758107       70              MOV     SP,#STCK        ;
0056 759000       71              MOV     P1,#00H         ;
0059 75A000       72              MOV     P2,#00H         ;
005C 75B000       73              MOV     P3,#00H         ;
005F D2B0         74              SETB    P3.0            ;
0061 D2B1         75              SETB    P3.1            ;
0063 D2B6         76              SETB    P3.6            ;
0065 758920       77              MOV     TMOD,#20H       ;
0068 7598D0       78              MOV     SCON,#0D0H      ;
006B 758840       79              MOV     TCON,#40H       ;
006E 75A890       80              MOV     IE,#90H         ;
0071 75B810       81              MOV!     IP,#10H         ;
0074 7900         82              MOV     R1,#00H
0076 7E00         83              MOV     R6,#00H
0078 7D00         84              MOV     R5,#00H
007A 7C00         85              MOV     R4,#00H
007C C220         86              CLR     BIT0            ;
007E 753B46       87              MOV     MESS9,#46H      ;
0081 753240       88              MOV     MESS0,#4DH      ;
0084 753349       89              MOV     MESS1,#49H      ;
0087 753443       90              MOV     MESS2,#43H      ;
```

```
LOC  OBJ        LINE   SOURCE

008A 753552      91          MOV     MESS3,#52H      ;
008D 753654      92          MOV     MESS4,#54H      ;
0090 753752      93          MOV     MESS5,#52H      ;
0093 753841      94          MOV     MESS6,#41H      ;
0096 75394B      95          MOV     MESS7,#4BH      ;
0099 753A7F      96          MOV     MESS8,#7FH
009C 1202AB      97          LCALL   DSPLY
009F 1202E6      98          LCALL   LATCH           ;
00A2 1202E6      99          LCALL   LATCH
00A5 753239     100          MOV     MESS0,#39H      ;
00A8 753334     101          MOV     MESS1,#34H      ;
00AB 753430     102          MOV     MESS2,#30H      ;
00AE 753530     103          MOV     MESS3,#30H      ;
00B1 75362A     104          MOV     MESS4,#2AH      ;
00B4 753757     105          MOV     MESS5,#57H      ;
00B7 753847     106          MOV     MESS6,#47H      ;
00BA 753953     107          MOV     MESS7,#53H      ;
00BD 753A00     108          MOV     MESS8,#00H
00C0 1202AB     109          LCALL   DSPLY
00C3 0200C6     110          LJMP    START1
                111     ;++++++++++++++++++++++++++++++++
                112     ;+++
                113     ;+++
                114     ;+++
                115     ;++++++++++++++++++++++++++++++++
00C6 1200F6     116     START1: LCALL   KSCAN           ;
00C9 BE00FA     117             CJNE    R6,#00H,START1  ;
00CC 1202AB     118             LCALL   DSPLY           ;
00CF 80F5       119             SJMP    START1
                120     ;————————————————————————————
                121     ;
                122     ;————————————————————————————————————
00D1 753252     123     INFORM: MOV     MESS0,#52H      ;
00D4 753345     124             MOV     MESS1,#45H      ;
00D7 75344D     125             MOV     MESS2,#4DH      ;
00DA 75352A     126             MOV     MESS3,#2AH      ;
00DD 753620     127             MOV     MESS4,#20H      ;
00E0 75374F     128             MOV     MESS5,#4FH      ;
00E3 753846     129             MOV     MESS6,#46H      ;
00E6 753946     130             MOV     MESS7,#46H      ;
00E9 1202AB     131             LCALL   DSPLY
00EC 0200EF     132             LJMP    DDNH20
00EF AB3B       133     DDNH20: MOV     R3,MESS9        ;
00F1 BB4E02     134             CJNE    R3,#4EH,KSCAN   ;
00F4 80F9       135             SJMP    DDNH20          ;
                136     ;++++++++++++++++++++++++++++++++
                137     ;+++
                138     ;+++
                139     ;+++
                140     ;++++++++++++++++++++++++++++++++
00F6 30870E     141     KSCAN:  JNB     P0.7,KSCAN2     ;
00F9 30D513     142     KSCAN3: JNB     F0,KSCAN1       ;
00FC C2D5       143             CLR     F0              ;
00FE 753F48     144             MOV     KEYM,#48H       ;
0101 753B46     145             MOV     MESS9,#46H      ;
0104 0201E6     146             LJMP    SEND
0107 1201DF     147     KSCAN2: LCALL   TIMER           ;
010A 308759     148             JNB     P0.7,MAINT      ;
010D 80EA       149             SJMP    KSCAN3
                150     ;————————————————————————————————————
                151     ;
                152     ;————————————————————————————————————
```

```
LOC  OBJ          LINE   SOURCE

010F AB3B          153   KSCAN1: MOV    R3,MESS9        ;
0111 BB4E03        154           CJNE   R3,#4EH,KSCAN4  ;
0114 0200D1        155           LJMP   INFORM          ;
0117 E580          156   KSCAN4: MOV    A,P0            ;
0119 B4FF01        157           CJNE   A,#0FFH,CLOSE1  ;
011C 22            158           RET
011D 1201DF        159   CLOSE1: LCALL  TIMER           ;
0120 E580          160           MOV    A,P0
0122 B4FF01        161           CJNE   A,#0FFH,CLOSE2  ;
0125 22            162           RET
0126 B4FE06        163   CLOSE2: CJNE   A,#0FEH,CLOSE3  ;
0129 753F41        164           MOV    KEYM,#041H      ;
012C 0201E6        165           LJMP   SEND            ;
012F B4FD06        166   CLOSE3: CJNE   A,#0FDH,CLOSE4  ;
0132 753F42        167           MOV    KEYM,#42H       ;
0135 0201E6        168           LJMP   SEND            ;
0138 B4FB06        169   CLOSE4: CJNE   A,#0FBH,CLOSE5  ;
013B 753F43        170           MOV    KEYM,#43H       ;
013E 0201E6        171           LJMP   SEND            ;
0141 B4F706        172   CLOSE5: CJNE   A,#0F7H,CLOSE6  ;
0144 753F44        173           MOV    KEYM,#44H       ;
0147 0201E6        174           LJMP   SEND            ;
014A B4EF06        175   CLOSE6: CJNE   A,#0EFH,CLOSE7  ;
014D 753F45        176           MOV    KEYM,#45H       ;
0150 0201E6        177           LJMP   SEND            ;
0153 B4DF06        178   CLOSE7: CJNE   A,#0DFH,CLOSE8  ;
0156 753F46        179           MOV    KEYM,#46H       ;
0159 0201E6        180           LJMP   SEND            ;
015C B4BF06        181   CLOSE8: CJNE   A,#0BFH,CLOSE9  ;
015F 753F47        182           MOV    KEYM,#47H       ;
0162 0201E6        183           LJMP   SEND            ;
0165 22            184   CLOSE9: RET
                   185   ;-----------------------------------------------------------
                   186   ;
                   187   ;-----------------------------------------------------------
0166 20D508        188   MAINT:  JB     F0,MAINT1       ;
0169 D2D5          189           SETB   F0              ;
016B 753F68        190           MOV    KEYM,#68H       ;
016E 0201E6        191           LJMP   SEND
0171 E580          192   MAINT1: MOV    A,P0            ;
0173 B47F01        193           CJNE   A,#7FH,MAINT2   ;
0176 22            194           RET
0177 1201DF        195   MAINT2: LCALL  TIMER           ;
017A E580          196           MOV    A,P0
017C B47F01        197           CJNE   A,#7FH,MAINT3   ;
017F 22            198           RET
0180 B47E06        199   MAINT3: CJNE   A,#7EH,MAINT4   ;
0183 753F61        200           MOV    KEYM,#61H       ;
0186 0201E6        201           LJMP   SEND            ;
0189 B47D06        202   MAINT4: CJNE   A,#7DH,MAINT5   ;
018C 753F62        203           MOV    KEYM,#62H       ;
018F 0201E6        204           LJMP   SEND            ;
0192 B47B09        205   MAINT5: CJNE   A,#7BH,MAINT6   ;
0195 753F63        206           MOV    KEYM,#63H       ;
0198 1201C3        207           LCALL  RMCHK           ;
019B 0201E6        208           LJMP   SEND            ;
019E B47706        209   MAINT6: CJNE   A,#77H,MAINT7   ;
01A1 753F64        210           MOV    KEYM,#64H       ;
01A4 0201E6        211           LJMP   SEND            ;
01A7 B46F06        212   MAINT7: CJNE   A,#6FH,MAINT8   ;
01AA 753F65        213           MOV    KEYM,#65H       ;
01AD 0201E6        214           LJMP   SEND            ;
01B0 B45F06        215   MAINT8: CJNE   A,#5FH,MAINT9   ;
```

```
LOC  OBJ        LINE   SOURCE

01B3 753F66      216          MOV    KEYM,#66H      ;
01B6 0201E6      217          LJMP   SEND           ;
01B9 B43F06      218   MAINT9: CJNE  A,#3FH,MAINTA  ;
01BC 753F67      219          MOV    KEYM,#67H      ;
01BF 0201E6      220          LJMP   SEND           ;
01C2 22          221   MAINTA: RET
                 222   ;————————————————————————————————————————
                 223   ;
                 224   ;————————————————————————————————————————
01C3 75322A      225   RMCHK:  MOV    MESS0,#2AH
01C6 753352      226          MOV    MESS1,#52H     ;
01C9 753445      227          MOV    MESS2,#45H     ;
01CC 75354D      228          MOV    MESS3,#4DH     ;
01CF 753643      229          MOV    MESS4,#43H     ;
01D2 753748      230          MOV    MESS5,#48H     ;
01D5 75384B      231          MOV    MESS6,#4BH     ;
01D8 75392A      232          MOV    MESS7,#2AH     ;
01DB 753A00      233          MOV    MESS8,#00H
01DE 22          234          RET
                 235   ;————————————————————————————
                 236   ;
                 237   ;————————————————————————————
01DF 753C40      238   TIMER:  MOV    TIME,#DELAY    ;
01E2 D53CFD      239   TIME1:  DJNZ   TIME,TIME1     ;
01E5 22          240          RET
                 241   ;————————————————————————————
                 242   ;
                 243   ;————————————————————————————
01E6 7B05        244   SEND:   MOV    R3,#05H
01E8 E53F        245          MOV    A,KEYM
01EA 20D01A      246          JB     P,PRTYX        ;
01ED C29B        247          CLR    TB8            ;
01EF BC00FD      248   SEND1:  CJNE   R4,#00H,SEND1  ;
01F2 853F99      249          MOV    SBUF,KEYM      ;
01F5 7C01        250          MOV    R4,#01H        ;
01F7 BE000A      251          CJNE   R6,#00H,SEND2
01FA E53F        252          MOV    A,KEYM
01FC B46302      253          CJNE   A,#63H,SEND3   ;
01FF 7B0A        254          MOV    R3,#0AH        ;
0201 1202AB      255   SEND3:  LCALL  DSPLY
0204 DBE9        256   SEND2:  DJNZ   R3,SEND1
0206 22          257          RET
0207 D29B        258   PRTYX:  SETB   TB8            ;
0209 BC00FD      259   PRTYX1: CJNE   R4,#00H,PRTYX1  ;
020C 853F99      260          MOV    SBUF,KEYM      ;
020F 7C01        261          MOV    R4,#01H        ;
0211 BE0003      262          CJNE   R6,#00H,PRTYX2
0214 1202AB      263          LCALL  DSPLY
0217 DBF0        264   PRTYX2: DJNZ   R3,PRTYX1
0219 22          265          RET
                 266   ;++++++
```

```
LOC  OBJ        LINE   SOURCE
0226 20D005      277          JB      P,PRTY1        ;
0229 209A60      278          JB      RB8,WRONGP
022C 8006        279          SJMP    PRTY2
022E 209A03      280   PRTY1: JB      RB8,PRTY2      ;
0231 02028C      281          LJMP    WRONGP
0234 B46205      282   PRTY2: CJNE    A,#062H,RCEVE1 ;
0237 7E01        283          MOV     R6,#01H        ;
0239 C220        284          CLR     BIT0           ;
023B 32          285          RETI
023C BE0104      286   RCEVE1: CJNE   R6,#01H,RCEVE2 ;
023F F532        287          MOV     MESS0,A        ;
0241 0E          288          INC     R6             ;
0242 32          289          RETI
0243 BE0204      290   RCEVE2: CJNE   R6,#02H,RCEVE3 ;
0246 F533        291          MOV     MESS1,A        ;
0248 0E          292          INC     R6             ;
0249 32          293          RETI
024A BE0304      294   RCEVE3: CJNE   R6,#03H,RCEVE4 ;
024D F534        295          MOV     MESS2,A        ;
024F 0E          296          INC     R6             ;
0250 32          297          RETI
0251 BE0404      298   RCEVE4: CJNE   R6,#04H,RCEVE5 ;
0254 F535        299          MOV     MESS3,A        ;
0256 0E          300          INC     R6             ;
0257 32          301          RETI
0258 BE0504      302   RCEVE5: CJNE   R6,#05H,RCEVE6 ;
025B F536        303          MOV     MESS4,A        ;
025D 0E          304          INC     R6             ;
025E 32          305          RETI
025F BE0604      306   RCEVE6: CJNE   R6,#06H,RCEVE7 ;
0262 F537        307          MOV     MESS5,A        ;
0264 0E          308          INC     R6             ;
0265 32          309          RETI
0266 BE0704      310   RCEVE7: CJNE   R6,#07H,RCEVE8 ;
0269 F538        311          MOV     MESS6,A        ;
026B 0E          312          INC     R6             ;
026C 32          313          RETI
026D BE0804      314   RCEVE8: CJNE   R6,#08H,RCEVE9 ;
0270 F539        315          MOV     MESS7,A        ;
0272 0E          316          INC     R6             ;
0273 32          317          RETI
0274 BE0904      318   RCEVE9: CJNE   R6,#09H,RCEVEA ;
0277 F53A        319          MOV     MESS8,A        ;
0279 0E          320          INC     R6             ;
027A 32          321          RETI
027B BE0A04      322   RCEVEA: CJNE   R6,#0AH,RCEVEB ;
027E F53B        323          MOV     MESS9,A        ;
0280 0E          324          INC     R6             ;
0281 32          325          RETI
0282 BE0B06      326   RCEVEB: CJNE   R6,#0BH,WRONGR ;
0285 B46503      327          CJNE    A,#065H,WRONGR ;
0288 7E00        328          MOV     R6,#00H        ;
028A 32          329          RETI
028B 32          330   WRONGR: RETI
028C D220        331   WRONGP: SETB   BIT0           ;
028E 32          332          RETI
                 333   ;-----------------------------------------------------
                 334   ;
                 335   ;-----------------------------------------------------
028F C220        336   PRTYED: CLR    BIT0           ;
0291 75322A      337          MOV     MESS0,#2AH     ;
0294 753350      338          MOV     MESS1,#50H     ;
```

```
LOC  OBJ        LINE   SOURCE
0297 753441      339          MOV    MESS2,#41H     ;
029A 753552      340          MOV    MESS3,#52H     ;
029D 753649      341          MOV    MESS4,#49H     ;
02A0 753754      342          MOV    MESS5,#54H     ;
02A3 753859      343          MOV    MESS6,#59H     ;
02A6 75392A      344          MOV    MESS7,#2AH     ;
02A9 8000        345          SJMP   DSPLY
                 346    ;*****************************************************
                 347    ;***
                 348    ;***
                 349    ;***
                 350    ;*****************************************************
02AB 2020E1      351    DSPLY:  JB     BIT0,PRTYED    ;
02AE 7932        352          MOV    R1,#032H       ;
02B0 7D17        353          MOV    R5,#17H        ;
02B2 D2B7        354          SETB   P3.7           ;
02B4 8740        355    DSPLY1: MOV    DSPLYM,@R1     ;
02B6 8DA0        356          MOV    P2,R5          ;
02B8 854090      357          MOV    P1,DSPLYM      ;
02BB C2B7        358          CLR    P3.7           ;
02BD 00          359          NOP                   ;
02BE D2B7        360          SETB   P3.7           ;
02C0 1D          361          DEC    R5             ;
02C1 09          362          INC    R1             ;
02C2 B936EF      363          CJNE   R1,#36H,DSPLY1 ;
02C5 7D1B        364          MOV    R5,#1BH        ;
02C7 8740        365    DSPLY2: MOV    DSPLYM,@R1     ;
02C9 8DA0        366          MOV    P2,R5          ;
02CB 854090      367          MOV    P1,DSPLYM      ;
02CE C2B7        368          CLR    P3.7           ;
02D0 00          369          NOP                   ;
02D1 D2B7        370          SETB   P3.7           ;
02D3 1D          371          DEC    R5             ;
02D4 09          372          INC    R1             ;
02D5 B93AEF      373          CJNE   R1,#3AH,DSPLY2 ;
02D8 75A00D      374          MOV    P2,#0DH        ;
02DB 8740        375          MOV    DSPLYM,@R1     ;
02DD 854090      376          MOV    P1,DSPLYM      ;
02E0 C2B7        377          CLR    P3.7           ;
02E2 00          378          NOP                   ;
02E3 D2B7        379          SETB   P3.7           ;
02E5 22          380          RET
                 381    ;-----------------------------
                 382    ;
                 383    ;-----------------------------
02E6 753DFF      384    LATCH:  MOV    LCHMSD,#PAUSE1 ;
02E9 753EFF      385          MOV    LCHLSD,#PAUSE2 ;
02EC E53E        386    LATCH1: MOV    A,LCHLSD
02EE 6009        387          JZ     LATCH2
02F0 D53EF9      388          DJNZ   LCHLSD,LATCH1  ;
02F3 E53D        389          MOV    A,LCHMSD       ;
02F5 B40001      390          CJNE   A,#00H,LATCH2  ;
02F8 22          391          RET                   ;
02F9 753EFF      392    LATCH2: MOV    LCHLSD,#0FFH
02FC 153D        393          DEC    LCHMSD
02FE 80EC        394          SJMP   LATCH1
                 395    ;-----------------------------
0FFD             396          ORG    0FFDH
                 397    ;-----------------------------
0FFD 020000      398          LJMP   START          ;
                 399          END
```

What is claimed is:

1. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive means for pivoting the pivotable frame to control the angular position of said pivotable frame responsive to the control signals; and moving means for automatically moving the edge sensors away from the web in response to an interlock dropout signal.

2. The web guidance system of claim 1 wherein the moving means further comprising means for automatically centering the pivotable frame in response to the interlock dropout signal.

3. The web guidance system of claim 2 further comprising means for automatically storing for a predetermined period of time the angular position of the pivotable frame and for automatically returning the pivotable frame to an angular position it had the predetermined time prior to detection of the interlock dropout signal.

4. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals response to the error signals for automatically correcting the deviation of the web position by pivoting the pivotable frame;

drive means for pivoting the pivotable frame to control the angular position of said pivotable frame responsive to the control signals; and means for automatically centering the pivotable frame in response to an interlock dropout signal.

5. The web guidance system of claim 4 wherein the means for automatically centering comprises means for disabling the generation of control signals for automatically correcting the deviation of the web responsive to the interlock dropout signal and for generating control signals to center the pivotable frame in response to the interlock dropout signal.

6. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive mans for pivoting the pivotable frame to control the angular position of said pivotable frame responsive to the control signals; and means for automatically storing for a predetermined period of time the angular position of he pivotable frame and for automatically returning the pivotable frame to an angular position it had the predetermined time prior to detection of an interlock dropout signal.

7. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive means for pivoting the pivotable frame to control the angular position of said pivotable frame responsive to the control signals; and means for enabling an operator to enter a web width value and a web offset value and means for automatically activating the edge sensors to find the edge of the web and correcting the web position to maintain the predetermined web width and offset in responsive to the interlock signal.

* * * * *

UNITED STATES PATENT AND TRADEMARK OFFICE

CERTIFICATE OF CORRECTION

PATENT NO. : 5,119,981

DATED : June 9, 1992

INVENTOR(S) : Herman C. Gnuechtel et al.

It is certified that error appears in the above-identified patent and that said Letters Patent is hereby corrected as shown below:

Col. 3, line 63, delete "44" and insert --34--.

Col. 4, line 26, delete "662" and insert --62--.

Col. 10, line 51, delete "open" and insert --oper--.

Col. 10, line 55, delete "open" and insert --oper--.

Col. 10, line 61, delete "open" and insert --oper--.

Col. 11, line 48, delete "10".

Col. 13, line 32, delete "10".

Col. 14, line 42, delete "10".

Col. 46, line 27, delete "he" and insert --the--.

UNITED STATES PATENT AND TRADEMARK OFFICE

CERTIFICATE OF CORRECTION

PATENT NO. : 5,119,981

DATED : June 9, 1992

INVENTOR(S) : Herman C. Gnuechtel et al

It is certified that error appears in the above-indentified patent and that said Letters Patent is hereby corrected as shown below:

Col. 46, line 58, delete "responsive" and isnert --response--.

Signed and Sealed this

Eleventh Day of January, 1994

Bruce Lehman

*Attest:*

BRUCE LEHMAN

*Attesting Officer*

*Commissioner of Patents and Trademarks*